US009458568B2

(12) United States Patent
Jia et al.

(10) Patent No.: US 9,458,568 B2
(45) Date of Patent: Oct. 4, 2016

(54) CREATION OF PATTERNS IN FIBROUS MATRICES USING LOCALIZED DISSOLUTION PRINTING

(71) Applicant: The Trustees of the Stevens Institute of Technology, Hoboken, NJ (US)

(72) Inventors: Chao Jia, Hoboken, NJ (US); Hongjun Wang, Millburn, NJ (US)

(73) Assignee: The Trustees of the Stevens Institute of Technology, Hoboken, NJ (US)

( * ) Notice: Subject to any disclaimer, the term of this patent is extended or adjusted under 35 U.S.C. 154(b) by 0 days.

(21) Appl. No.: 14/545,569

(22) Filed: May 22, 2015

(65) Prior Publication Data

US 2015/0337489 A1 Nov. 26, 2015

Related U.S. Application Data

(60) Provisional application No. 62/002,290, filed on May 23, 2014.

(51) Int. Cl.

| | |
|---|---|
| ***D06Q 1/02*** | (2006.01) |
| ***B32B 37/00*** | (2006.01) |
| ***D06M 23/10*** | (2006.01) |
| ***D06M 23/16*** | (2006.01) |

(52) U.S. Cl.

CPC ..... *D06Q 1/02* (2013.01); *D06M 23/10* (2013.01); *D06M 23/16* (2013.01)

(58) Field of Classification Search

None

See application file for complete search history.

(56) References Cited

U.S. PATENT DOCUMENTS

| | | | | |
|---|---|---|---|---|
| 3,874,958 | A * | 4/1975 | Scholtis | D06Q 1/02 156/155 |
| 2005/0100705 | A1* | 5/2005 | Kiff | D06P 5/12 428/89 |
| 2008/0112998 | A1* | 5/2008 | Wang | A61K 35/32 424/423 |
| 2011/0193900 | A1* | 8/2011 | Aruga | B41J 2/16526 347/6 |
| 2012/0045752 | A1* | 2/2012 | Ensor | B82Y 15/00 435/5 |
| 2012/0276518 | A1* | 11/2012 | Gillis | A01N 1/0221 435/1.1 |
| 2015/0202423 | A1* | 7/2015 | Adenusi | A61M 39/08 428/36.4 |
| 2015/0211151 | A1* | 7/2015 | Taylor | D01F 6/84 428/221 |
| 2015/0246072 | A1* | 9/2015 | Bhatia | A61L 27/18 424/93.7 |

OTHER PUBLICATIONS

Greiner et al., "Electrospinning: A Fascinating Method for the Preparation of Ultrathin Fibers," Angewandte Chemie International Edition, vol. 46, Issue 30, pp. 5670-5703, Jul. 23, 2007.

Li et al., "Collecting Electrospun Nanofibers with Patterned Electrodes," Nano Letters, vol. 5, Issue 5, pp. 913-916, Apr. 9, 2005.

Zhang et al., "Patterning of Electrospun Fibers Using Electroconductive Templates," Advanced Materials, vol. 19, Issue 21, pp. 3664-3667, Nov. 5, 2007.

(Continued)

*Primary Examiner* — Shamim Ahmed

(74) *Attorney, Agent, or Firm* — Greenberg Traurig, LLP

(57) ABSTRACT

A method for fabricating a patterned fibrous matrix includes providing a printer adapted to use an etching solvent as an ink; providing to the printer a fibrous matrix to use as a printing medium; providing to the printer a pattern for printing on the fibrous matrix; printing by the printer the pattern on the fibrous matrix; and receiving from the printer the patterned fibrous matrix with the pattern etched thereon.

19 Claims, 18 Drawing Sheets
(13 of 18 Drawing Sheet(s) Filed in Color)

(56) References Cited

OTHER PUBLICATIONS

Katta et al., "Continuous Electrospinning of Aligned Polymer Nanofibers onto a Wire Drum Collector," Nano Letters, vol. 4, Issue 11, pp. 2215-2218, Sep. 28, 2004.

Bietsch et al., "Rapid functionalization of cantilever array sensors by inkjet printing," Nanotechnology, vol. 15, Issue 8, pp. 873-880, Jun. 9, 2004.

Smith et al., "Spatial Control of Cell Expansion by the Plant Cytoskeleton," Annual Review of Cell and Developmental Biology, vol. 21, pp. 271-295, Jun. 28, 2005.

Kapoor et al., "Microtopographically patterned surfaces promote the alignment of tenocytes and extracellular collagen," Acta Biomaterialia, vol. 6, pp. 2580-2589, Jan. 4, 2010.

Teixeira et al., "Epithelial contact guidance on well-defined micro- and nanostructured substrates," Journal of Cell Science, vol. 116, Issue 10, pp. 1881-1892, Jan. 21, 2003.

Walicke et al., "Fibroblast growth factor promotes survival of dissociated hippocampal neurons and enhances neurite extension," Proceedings of the National Academy of Sciences of the United States of America, vol. 83, pp. 3012-3016, May 1986.

Mahoney et al., "Three-dimensional growth and function of neural tissue in degradable polyethylene glycol hydrogels," Biomaterials, vol. 27, Issue 10, pp. 2265-2274, Nov. 28, 2005.

Liu et al., "Electrospun Nanofibers for Regenerative Medicine," Advanced Healthcare Materials, vol. 1, Issue 1, pp. 10-25, Jan. 11, 2012.

Xie et al., "Nanofiber Membranes with Controllable Microwells and Structural Cues and Their Use in Forming Cell Microarrays and Neuronal Networks", Small, vol. 7, Issue 3, pp. 293-297, Feb. 7, 2011.

* cited by examiner

DETAIL 3I

| Parameter | Range | Pore Size ($D_p$, μm) | Unprinted Area Width ($D_g$, μm) |
|---|---|---|---|
| Drop Distance (DD) | 15 | 148.0±2.9 | 43.7±1.6 |
| | 30 | 134.6±3.5 | 67.5±1.9 |
| | 45 | 106.5±0.7 | 92.5±1.3 |
| | 60 | 60.9±1.3 | 140.6±2.3 |
| | 90 | 59.5±1.3 | 142.3±1.5 |
| Drop Size (DS) | 15 | 62.1±1.9 | 136.6±1.9 |
| | 20 | 90.3±1.3 | 125.2±2.1 |
| | 25 | 106.9±1.2 | 95.6±2.3 |
| | 30 | 107.7±2.2 | 87.4±1.2 |
| | 35 | 136.1±0.8 | 73.7±1.1 |
| | 40 | 145.3±2.6 | 53.3±1.8 |
| Nozzle Number (N) | 1 | 91.3±1.4 | 74.9±1.1 |
| | 2 | 142.9±1.8 | 48.2±0.8 |
| | 3 | 177.1±6.7 | 30.7±4.0 |
| | 4 | 178.1±6.7 | 24.5±2.6 |
| | 5 | 155.7±6.0 | 30.6±4.0 |

FIG. 5

DETAIL 10B

DETAIL 10D

DETAIL 10E

DETAIL 10F

DETAIL 11E

DETAIL 11B

DETAIL 11D

DETAIL 11F

CREATION OF PATTERNS IN FIBROUS MATRICES USING LOCALIZED DISSOLUTION PRINTING

PRIORITY CLAIM

This application is a Section 111(a) application relating to and claiming the benefit of commonly owned, U.S. Provisional Patent Application Ser. No. 62/002,290 entitled "CREATION OF PATTERNS IN FIBROUS MATRICES USING MICROETCHING PRINTING," filed May 23, 2014, the entirety of which is incorporated herein by reference.

FIELD OF THE INVENTION

The exemplary embodiments relate to fibrous matrices and, more particularly, to the creation thereof through the use of localized dissolution printing.

BACKGROUND OF THE INVENTION

Electrospinning is a technique wherein fine fibers are drawn from a liquid by the application of an electrical charge. Electrospinning enables the fabrication of submicrometer and nanometer fibers from a melt or a solution of various materials (e.g., polymeric or blended materials), and therefore has been widely adopted to fabricate fibrous matrices with highly connected porous structures for filtration, catalysis, medicine, and other applications. The diameter of fibers fabricated by electrospinning can be modulated within the nanometer to micrometer range by tuning various parameters such as solution concentration, solution feeding rate, collection distance, electric field intensity, and the spinneret diameter. In addition, intervention of an electric field during fiber collection, such as by using a rotating mandrel for collecting aligned fibers, allows for a certain degree of manipulation of the fiber organization in the collected fibrous matrices.

Various applications exist for fibrous matrices with patterns created thereon, such as guiding the flow of reactants across fibrous meshes. The requirements on patterns created on fibrous matrices are more demanding for regenerative medicine, in which different cells need to follow unique spatial organization to better recapture the physiologic functions and complex characteristics of native tissues. However, there is currently no robust approach available for rapid and cost-effective creation of arbitrary patterns on fibrous meshes.

SUMMARY OF THE INVENTION

In an embodiment, the present invention relates to a method for fabricating a patterned fibrous matrix including the steps of providing a printer adapted to use an etching solvent as an ink; providing to the printer a fibrous matrix for use as a printing medium; providing to the printer a pattern for printing on the fibrous matrix; printing by the printer the pattern on the fibrous matrix; and receiving from the printer the patterned fibrous matrix with the pattern etched thereon.

In an embodiment, the etching solvent includes one or more of hexafluoroisopropanol, dimethylformamide, dichloromethane, chloroform, trifluoroethanoic acid, water, a protein, a peptide, a hormone, a cell, DNA, and bovine serum albumin. In an embodiment, the etching solvent includes hexafluoroisopropanol and dimethylformamide at a ratio of about 9:1. In an embodiment, the etching solvent includes hexafluoroisopropanol and bovine serum albumin. In an embodiment, the fibrous matrix includes one or more of polycaprolactone, collagen, poly(lactic-co-glycolic acid), polyethylene glycol, poly(ethylene oxide), fibrinogen, gelatin, polylactic acid, and polyglycolic acid. In an embodiment, the fibrous matrix includes a polycaprolactone (8%)/collagen (8%) (1:1 v/v) blend solution. In an embodiment, the fibrous matrix is fabricated by a process including electrospinning.

In an embodiment, the printer includes an inkjet printer. In an embodiment, the inkjet printer includes a piezoelectric inkjet printer. In an embodiment, the patterned fibrous matrix includes a three-dimensional construct. In an embodiment, the patterned fibrous matrix includes a groove having a width less than about 100 μm.

In an embodiment, the method also includes the step of culturing a cell culture on the patterned fibrous matrix. In an embodiment, the cell culture includes one of normal human dermal fibroblast cells, mouse endothelial cells, and human fetal neural stem cells.

In an embodiment, the method also includes the step of configuring a printing parameter of the printer based on a desired parameter of the patterned fibrous matrix. In an embodiment, the printing parameter is one of a drop size, a drop distance, and a quantity of printing nozzles. In an embodiment, the drop size is in a range from about 3.75 picoliters to about 10 picoliters. In an embodiment, the drop distance is a range from about 15 microns to about 90 microns. In an embodiment, the quantity of printing nozzles is in a range from one to sixteen. In an embodiment, the parameter of the patterned fibrous matrix is one of a pore size and a width of an unprinted area. In an embodiment, the pattern is formatted in a computer-aided design format.

BRIEF DESCRIPTION OF FIGURES

The patent or application file contains at least one drawing executed in color. Copies of this patent or patent application publication with color drawing(s) will be provided by the Office upon request and payment of the necessary fee.

FIG. 5 is a chart showing the relationship between various key parameters that may be used to configure the exemplary system of FIG. 1 and the resulting patterns printed on fibrous matrices;

DETAILED DESCRIPTION OF THE INVENTION

The exemplary embodiments aim to address the challenge of forming patterned fibrous matrices suitable for use in applications such as regenerative medicine by printing etching solvent onto fibrous matrices using high-resolution inkjet printing techniques and etching out (e.g., locally dissolving) part of the fibers. By manipulating different parameters, such as drop distance ("DD"), drop size ("DS"), nozzle number ("NN"), and input patterns used for printing, it is possible to generate multiscale scaffolds with different topography and patterns. Additionally, the exemplary embodiments make it possible to rapidly form large pores with controlled size, morphology and arrangement to efficiently address another challenge associated with current fibrous matrices, that is, small pore size (<5 μm) with limited infiltration of cells and nutrition. As a result, the exemplary embodiments can significantly expand the utility of current fibrous scaffolds.

The exemplary embodiments employ microetching printing using an inkjet-printer to create various patterns in electrospun fibrous matrices without sacrificing the superiority of electrospun fibers. In an embodiment, etching solvent is loaded into the printer cartridge as "ink" and electrospun fiber matrices are used as "paper". During printing, the etching solvent deposited by the printer partially dissolves the contacted fibers to generate pores, while the remaining fibers of the printed area fuse together into thicker fibers to connect the intact area of electrospun meshes. Due to surface tension, the formed thicker fibers generally have a defined diameter and a stable pattern.

Figure 1:
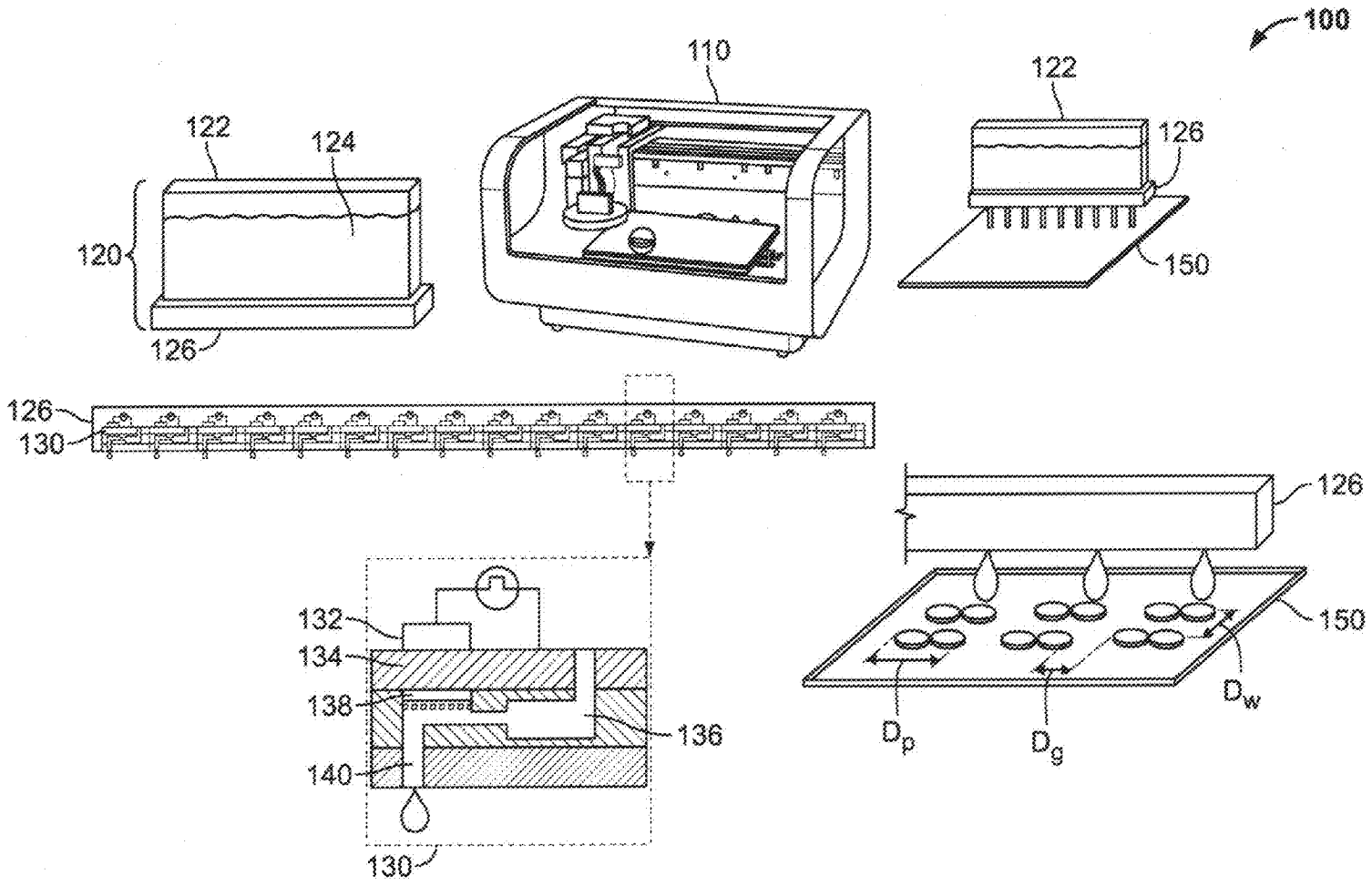
FIG. 1 is a schematic illustration of an exemplary system for localized dissolution printing.

FIG. 1 schematically illustrates a system 100 for performing etching according to an exemplary embodiment. The system includes a piezoelectric inkjet printer 110. In an embodiment, the printer 110 is a Dimatix DMP-2831 Piezoelectric Drop-on-Demand Printer manufactured by Fujifilm Dimatix, Inc., of Lebanon, N.H., having a maximum printing area of 20 cm×30 cm. The printer 110 includes a cartridge 120, which comprises an ink reservoir 122 holding an etching solvent 124 and a printing head 126. The printing head 126 includes a plurality of nozzles 130 in a linear arrangement and spaced at regular intervals (e.g., about 254 μm apart). Each nozzle 130 includes a piezoelectric plate 132 disposed on a first side of a diaphragm 134 and adapted to selectively apply pressure to the diaphragm 134. An inlet 136 passes through the diaphragm 134 enabling the etching solvent 124 to pass from the ink reservoir 122 to a chamber 138 on a second side of the diaphragm 134 opposite the piezoelectric plate 132. Pressure exerted on the diaphragm 134 by the piezoelectric plate 132 causes the etching solvent to pass through an orifice 140 and onto a medium 150 (e.g., an electrospun fiber matrix).

Broadly described, an exemplary technique involves the following process. Initially, electrospinning is performed to fabricate fibrous meshes from source materials, which may include any polymer capable of being electrospun into fibrous matrices. In an embodiment, the source material includes polycaprolactone ("PCL"). In an embodiment, the source material includes collagen. In an embodiment, the source material includes poly(lactic-co-glycolic acid) ("PLGA"). In an embodiment, the source material includes polyethylene glycol ("PEG"). In an embodiment, the source material includes poly(ethylene oxide) ("PEO"). In an embodiment, the source material includes fibrinogen. In an embodiment, the source material includes gelatin. In an embodiment, the source material includes polylactic acid ("PLA"). In an embodiment, the source material includes polyglycolic acid ("PGA"). In an embodiment, the source material includes two or more of the above. In an embodiment, the source material includes a PCL (8%)/collagen (8%) (1:1 v/v) blend solution.

Figure 2A:
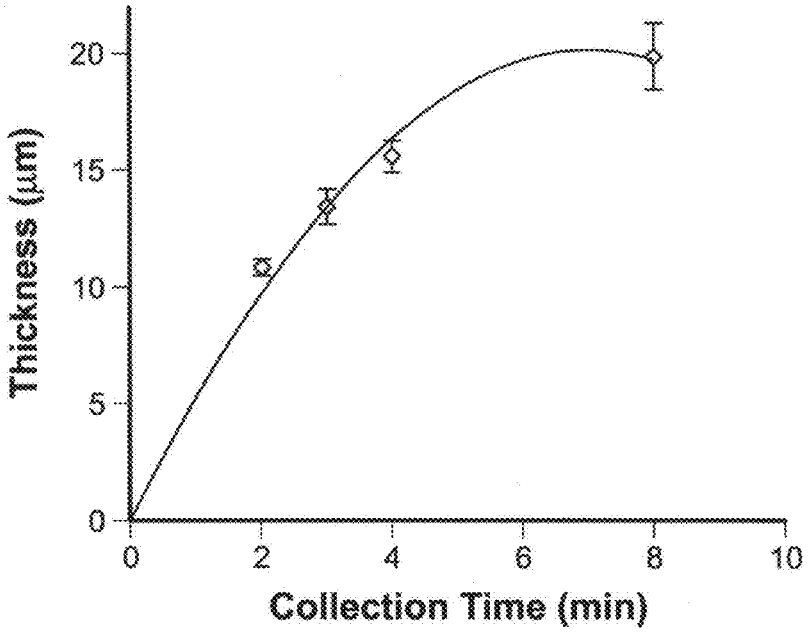
FIG. 2A is a first graph showing the relationship between fiber collection time and the thickness of fibrous matrices.
Figure 2B:
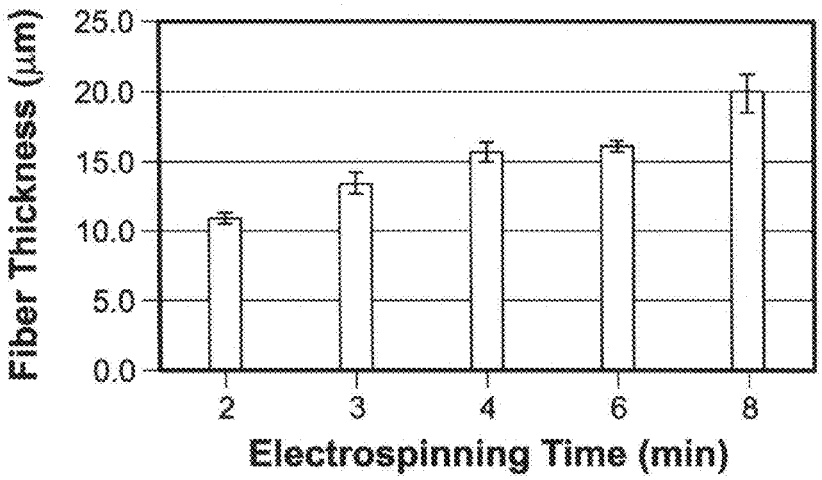
FIG. 2B is a second graph showing the relationship between fiber collection time and the thickness of fibrous matrices.

In an embodiment, the electrospinning conditions include a flow rate of 10 μL/min, a voltage of 15 kV, and a needle-to-collector distance of 10 cm. In an embodiment using the source material and electrospinning conditions described above, 1:1 PCL/collagen (8%, w/v) blend solution is electrospun into fibers with a diameter of 250 nm to 500 nm and fibers are randomly collected onto metal rings with a diameter of 3 centimeters. It will be apparent to those of skill in the art that the parameters of the electrospinning (e.g., source material, flow rate, voltage, etc.) may be varied without departing from the general principles of the exemplary embodiments. During the electrospinning, which is the process of fabricating the fibers (e.g., fine strands or filaments) under an electric field, the formed fibers are deposited onto a collecting surface to form a continuous 3D matrix. Depending on the materials used and the electrospinning conditions, a variety of fibrous matrices can be fabricated with various configurations (e.g., fiber diameter, fiber organization, interfiber distance, matrix thickness, etc.) by manipulating, for example, the collection time and collection surface area. Further, the thickness of a fibrous matrix collected on a substrate can be controlled. FIGS. 2A and 2B illustrate the correlation between fiber collection time and the thickness of fibrous matrices. In particular, FIG. 2A indicates that the thickness y of a fiber matrix, in microns, may be estimated based on the collection time x, in minutes, according to the expression $y=-0.407x^2+5.7329x$, with an $R^2$ value of 0.99201.

In the next step of the exemplary technique, an inkjet printer is used to print an etching ink including a solvent onto the fibrous matrices produced through the electrospinning process described above. In an embodiment, prior to printing, a pattern editor program is used to create a desired pattern for printing. In an embodiment, the pattern editor program may be included with the printer to be used. In an embodiment, the solvent includes hexafluoroisopropanol ("HFIP"). In an embodiment, the solvent includes dimethylformamide ("DMF"). In an embodiment, the solvent includes dichloromethane ("DCM"). In an embodiment, the solvent includes chloroform. In an embodiment, the solvent includes trifluoroethanoic acid ("TFA"). In an embodiment, the solvent includes water. In an embodiment, the solvent includes another material not specifically listed herein that is capable of completely or partially dissolving a fibrous matrix. In an embodiment, the solvent includes one or more of the above. In an embodiment, a mixture of HFIP and DMF at a ratio of 9:1 is used as the etching ink. In an embodiment, the etching ink is printed with a nominal drop volume of 10 μL. In an embodiment, the etching ink includes further ingredients in addition to solvent, which would remain in the locally dissolved location. In an embodiment, the other ingredients include biologically active molecules. In an embodiment, the other ingredients include bovine serum albumin. In an embodiment, the other ingredients include a protein. In an embodiment, the other ingredients include a peptide. In an embodiment, the other ingredients include a hormone. In an embodiment, the other ingredients include a cell. In an embodiment, the other ingredients include DNA. In an embodiment, the other ingredients include two or more of the above.

Generally, any inkjet printer can be used to print an etching solvent onto electrospun fibrous matrices (e.g., PCL/collagen fiber matrices). In an embodiment, the Dimatix Materials Printer DMP-2831 described above with reference to FIG. 1 is used. As described above, the exemplary printer 110 includes the cartridge 120, which has a plurality of the nozzles 130. In an embodiment, the cartridge 120 includes sixteen of the nozzles 130, each of which is separately controlled by a corresponding piezoelectric plate 132 generating pressure to push the etching solvent 124 through the orifice 140 and form a drop on the target medium (e.g., as described above, PCL/collagen fiber matrices). The printing etching solvent 124 differs from printing a polymer solution, which has a high viscosity and a low flow rate. To control the results, in addition to the input of a desired printing pattern, several key parameters may be varied to control the resulting pattern. These parameters include drop distance ("DD"), representing the distance between adjacent printed drops, which may be expressed in μm; drop size ("DS"), representing the size of each printed drop, which may be expressed in pL; and nozzle number ("NN"), representing the number of nozzles used for printing.

Figure 3A:
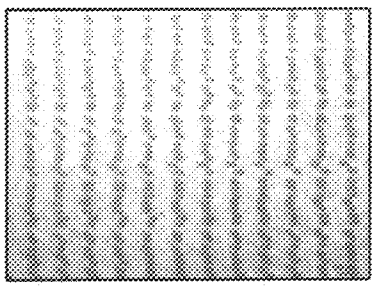
FIG. 3A is a first scanning electron microscope ("SEM") image showing the relationship between various key parameters that may be used to configure the exemplary system of FIG. 1 and the resulting patterns printed on fibrous matrices.
Figure 3D:
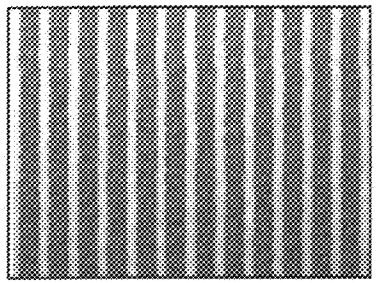
FIG. 3D is a fourth SEM image showing the relationship between various key parameters that may be used to configure the exemplary system of FIG. 1 and the resulting patterns printed on fibrous matrices.
Figure 3G:
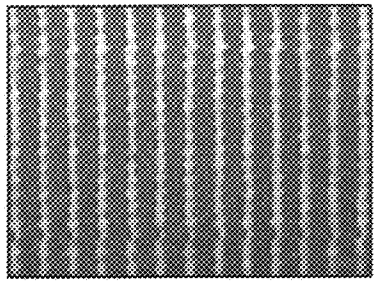
FIG. 3G is a seventh SEM image showing the relationship between various key parameters that may be used to configure the exemplary system of FIG. 1 and the resulting patterns printed on fibrous matrices.
Figure 3B:
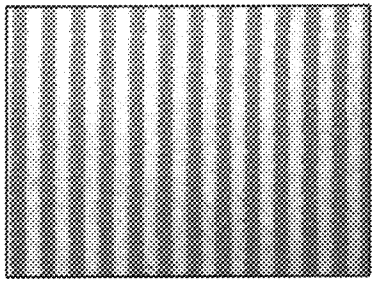
FIG. 3B is a second SEM image showing the relationship between various key parameters that may be used to configure the exemplary system of FIG. 1 and the resulting patterns printed on fibrous matrices.
Figure 3E:
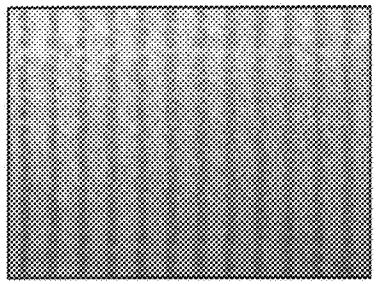
FIG. 3E is a fifth SEM image showing the relationship between various key parameters that may be used to configure the exemplary system of FIG. 1 and the resulting patterns printed on fibrous matrices.
Figure 3H:
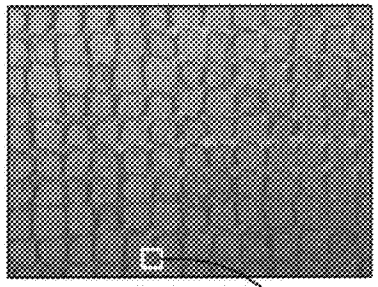
FIG. 3H is an eighth SEM image showing the relationship between various key parameters that may be used to configure the exemplary system of FIG. 1 and the resulting patterns printed on fibrous matrices.
Figure 3C:
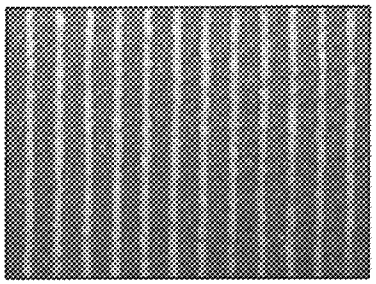
FIG. 3C is a third SEM image showing the relationship between various key parameters that may be used to configure the exemplary system of FIG. 1 and the resulting patterns printed on fibrous matrices.

With specific reference to the Dimatix Materials Printer DMP-2831 printer 110 described above with reference to FIG. 1, drop size may be tuned by varying the voltage applied to piezoelectric plate 132 within a range from 15 mV to 40 mV, with drop size varying linearly with respect to voltage and a largest DS of 10 pL occurring at an applied voltage of 40 mV; because of this linear variance, DS may alternatively be expressed in terms of mV applied to a nozzle. During printing, the area of a fibrous mesh (e.g., a PCL/collagen matrix) etched by a solvent drop is closely correlated with DS. FIGS. 3A, 3B and 3C illustrate the manner in which the printed pattern varies with DS while DD and NN are held constant, with FIG. 3A illustrating a pattern produced by an input voltage of 15 mV, FIG. 3B illustrating a pattern produced by an input voltage of 30 mV, and FIG. 3C illustrating a pattern produced by an input voltage of 40 mV. It may be observed that, both the pore size ($D_p$) and intact matrix width ($D_g$ as measured along an axis parallel to the cartridge 120 and $D_w$ as measured along an axis perpendicular to the cartridge 120) are linear functions of DS.

Figure 4A:
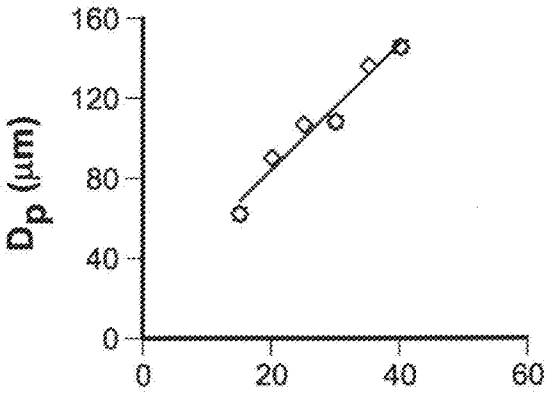
FIG. 4A is a first graph showing the relationship between various key parameters that may be used to configure the exemplary system of FIG. 1 and the resulting patterns printed on fibrous matrices.
Figure 4B:
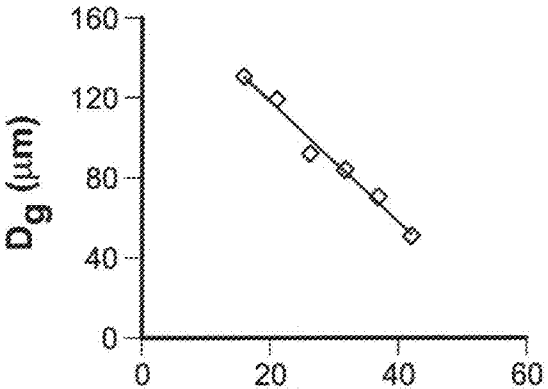
FIG. 4B is a second graph showing the relationship between various key parameters that may be used to configure the exemplary system of FIG. 1 and the resulting patterns printed on fibrous matrices.

FIG. 4A illustrates the linear increase of $D_p$ as DS increases. Specifically, FIG. 4A indicates that the pore size Dp, in microns, can be determined based on the drop size DS, in mV, according to the expression $D_p$=3.1687DS+20.924. This expression has an $R^2$ value of 0.95369. FIG. 4B illustrates the linear decrease of $D_g$ as DS increases. Specifically, FIG. 4B indicates that the matrix width $D_g$, in microns, can be determined based on the drop size DS, in mV, according to the expression $D_g$=−3.3094DS+186.3. This expression has an $R^2$ value of 0.97942. The same expression is accurate for the matrix width $D_w$. In both cases, it will be apparent to those of skill in the art that an actual drop volume (e.g., in picoliters) has a linear relationship to a voltage used to deposit the drop, as described above; though the specific parameters of this linear relationship may be specific to the printer 110 described above with reference to FIG. 1, those of skill in the art will understand that a linear relationship may also exist where DS is expressed in volume, and for other printer models.

Figure 3F:
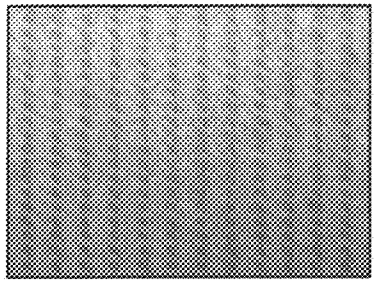
FIG. 3F is a sixth SEM image showing the relationship between various key parameters that may be used to configure the exemplary system of FIG. 1 and the resulting patterns printed on fibrous matrices.

Continuing to refer to the Dimatix Materials Printer DMP-2831 printer 110 described above with reference to FIG. 1, DD may be varied in the range between 0 and 254 μm. However, for printing, DD may be varied in a range that yields continuous printing without over-etching the fibrous matrices. Considering a DD range between 15 μm and 90 μm, it may be observed that a DD value larger than 60 μm leads to a discrete printing of PCL/collagen fibrous matrices, whereas a DD value of 45 μm is sufficient for continuous printing. FIGS. 3D, 3E, and 3F illustrate the manner in which the printed pattern varies with DD while DS and NN are held constant, with FIG. 3D illustrating a pattern produced by a DD value of 30 μm, FIG. 3E illustrating a pattern produced by a DD value of 60 μm, and FIG. 3F illustrating a pattern produced by a DD value of 90 μm. It may be observed that, over a range of DD values from 15 to 60 μm, pore size $D_p$ exhibits a 2-order polynomial decrease and intact matrix width $D_g$ shows an exponential increase.

Figure 4C:
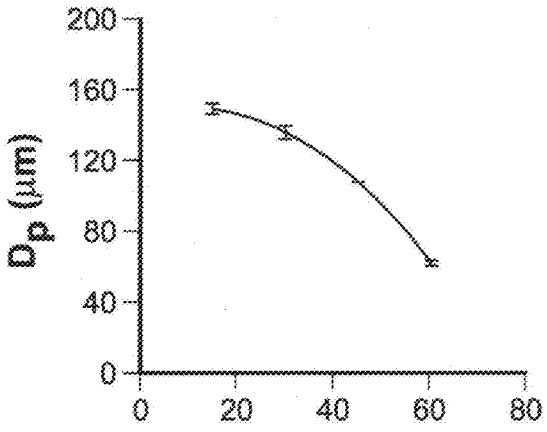
FIG. 4C is a third graph showing the relationship between various key parameters that may be used to configure the exemplary system of FIG. 1 and the resulting patterns printed on fibrous matrices.
Figure 4D:
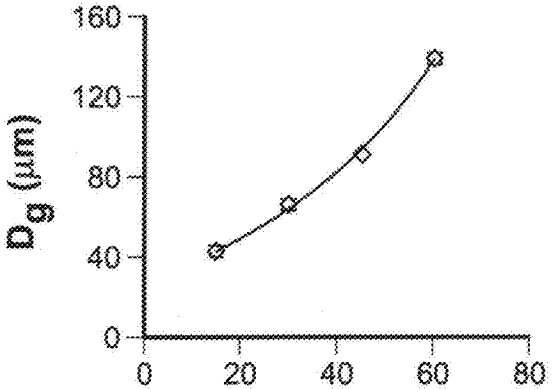
FIG. 4D is a fourth graph showing the relationship between various key parameters that may be used to configure the exemplary system of FIG. 1 and the resulting patterns printed on fibrous matrices.

FIG. 4C illustrates the decrease of $D_p$ as DD increases. Specifically, FIG. 4C indicates that the pore size $D_p$, in microns, can be determined based on the drop distance DD, in microns, according to the expression $D_p=-0.358DD^2+0.7562DD+144.56$. This expression has an $R^2$ value of 0.99992. FIG. 4D illustrates the increase of $D_g$ as DD increases. Specifically, FIG. 4D indicates that the matrix width $D_g$, in microns, can be determined based on the drop distance DD, in microns, according to the expression $D_g=30.3e^{0.0255x}$. This expression has an $R^2$ value of 0.99659. The same expression is accurate for the matrix width $D_w$.

Figure 3I:
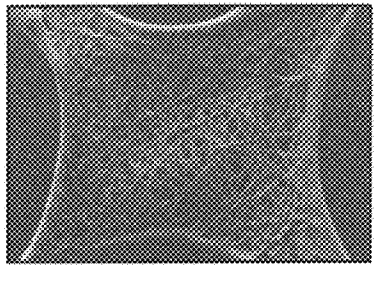
FIG. 3I is a detailed view of a portion of the SEM image of FIG. 3H, which is denoted as DETAIL 3I in FIG. 3H, showing the unprinted area remaining on the fibrous morphology.

Continuing to refer to the Dimatix Materials Printer DMP-2831 printer 110 described above with reference to FIG. 1, although all sixteen of the nozzles 130 can be used to print the solvent, excessive solvent as a result of the untimely evaporation after printing can diffuse to neighboring unprinted areas, leading to additional unwanted etching of fibrous matrices. This may consequently affect pore size $D_p$ and unprinted area width ($D_g$ and $D_w$) of resultant patterns. Therefore, in an embodiment, between one and five nozzles may be used for printing. FIGS. 3G and 3H illustrate the manner in which the printed pattern varies with NN while DS and DD are held constant, with FIG. 3G illustrating a pattern produced by a NN value of 2 and FIG. 3H illustrating a pattern produced by a NN value of 4. Despite a noted fusion at the edge of unprinted regions, a majority of the intact fibers retain their initial morphology similar to that prior to the printing (e.g., the PCL/collagen fibers shown in FIG. 3I).

Continuing to refer to the Dimatix Materials Printer DMP-2831 printer described above with reference to FIG. 1, FIG. 5 presents a table 500 showing the variation of output patterns achieved by varying each of the input parameters DD, DS, and NN, while the other two parameters are held constant.

In an embodiment, for PCL/collagen fibrous matrices, the printing conditions may be 30DS, 45DD and 1 NN, and the etching ink may include a mixture of HFIP and DMF at a ratio of 9:1; however, it will be apparent to those of skill in the art that printing conditions need to be optimized for any given selection of target medium and etching solvent. Thus, it is necessary to determine the printing accuracy and reproducibility of a particular set of printing conditions. In an embodiment, using PCL/collagen fibrous matrices as the model substrate, the accuracy of microetching printing in creating one-dimensional patterns was investigated by printing parallel strips with various designated widths for unprinted areas from 10 to 500 μm.

Figure 6C:
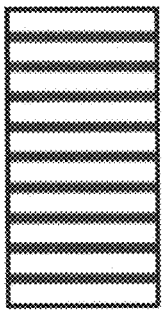
FIG. 6C is a detailed view of a second portion of the exemplary input pattern of FIG. 6A, which is denoted as DETAIL 6C in FIG. 6A.
Figure 6E:
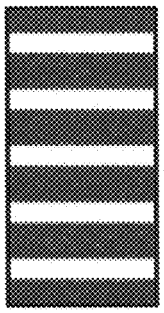
FIG. 6E is a detailed view of a fourth portion of the exemplary input pattern of FIG. 6A, which is denoted as DETAIL 6E in FIG. 6A.
Figure 6G:
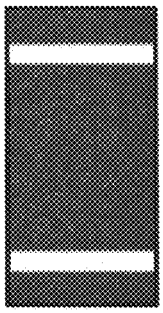
FIG. 6G is a detailed view of a sixth portion of the exemplary input pattern of FIG. 6A, which is denoted as DETAIL 6G in FIG. 6A.
Figure 6B:
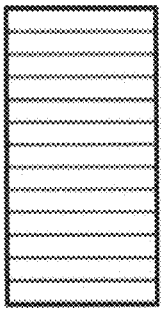
FIG. 6B is a detailed view of a first portion of the exemplary input pattern of FIG. 6A, which is denoted as DETAIL 6B in FIG. 6A.
Figure 6D:
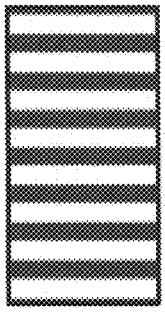
FIG. 6D is a detailed view of a third portion of the exemplary input pattern of FIG. 6A, which is denoted as DETAIL 6D in FIG. 6A.
Figure 6F:
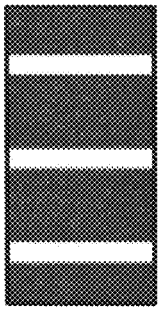
FIG. 6F is a detailed view of a fifth portion of the exemplary input pattern of FIG. 6A, which is denoted as DETAIL 6F in FIG. 6A.
Figure 6A:
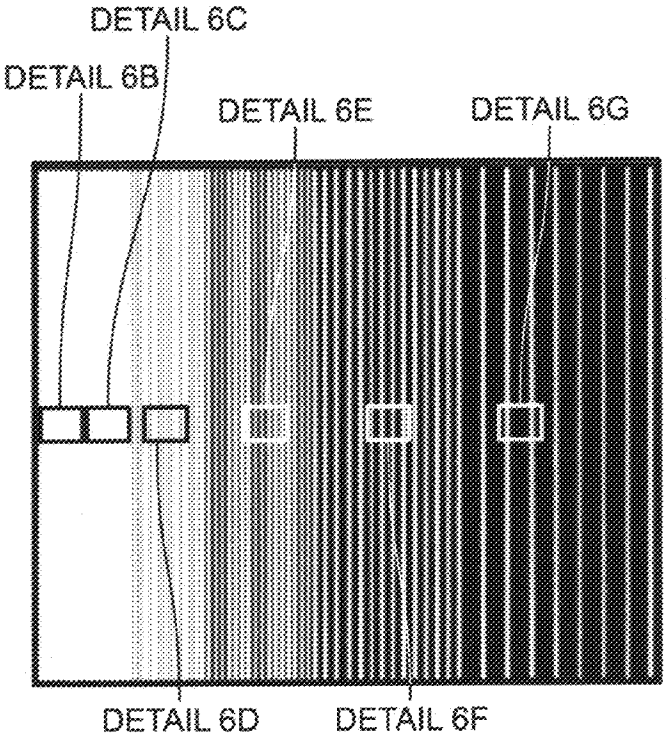
FIG. 6A is a first exemplary input pattern that may be provided to the exemplary system of FIG. 1.

FIGS. 6A-6G illustrate an exemplary input pattern. In an embodiment, input patterns are generated in a computer-aided design ("CAD") format. In an embodiment, input patterns are generated in a data format appropriate for use with AutoCAD software distributed by Autodesk, Inc., of San Rafael, Calif. The areas shown in white in FIGS. 6A-6G are printed areas having a constant width of 50 μm. The areas shown in black in FIGS. 6A-6G are unprinted areas having varying width. FIG. 6A illustrates the overall pattern covering the entire range of strip widths. FIGS. 6B-6G illustrate detailed views of various portions of the overall pattern shown in FIG. 6A. FIG. 6B shows an area of FIG. 6A having unprinted areas having width of 10 μm. FIG. 6C shows an area of FIG. 6A having unprinted areas having width of 20 μm. FIG. 6D shows an area of FIG. 6A having unprinted areas having width of 50 μm. FIG. 6E shows an area of FIG. 6A having unprinted areas having width of 100 μm. FIG. 6F shows an area of FIG. 6A having unprinted areas having width of 200 μm. FIG. 6G shows an area of FIG. 6A having unprinted areas having width of 500 μm.

Figure 7A:
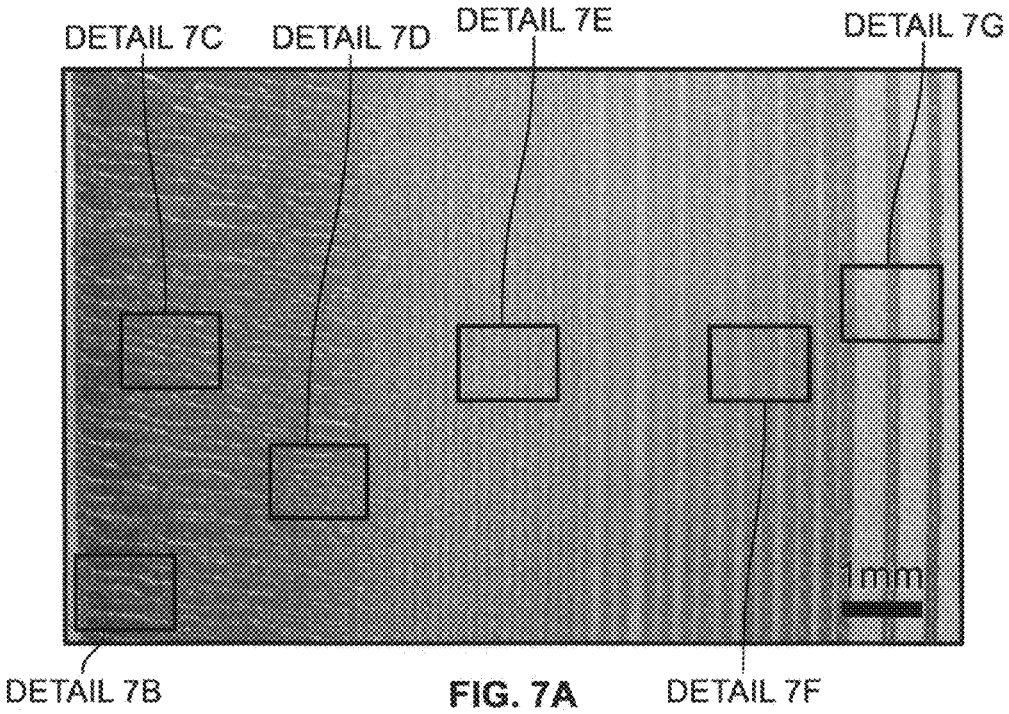
FIG. 7A is a stereomicroscopic image of a fibrous matrix that may result from printing the exemplary input pattern of FIG. 6A with the exemplary system of FIG. 1.
Figure 7B:
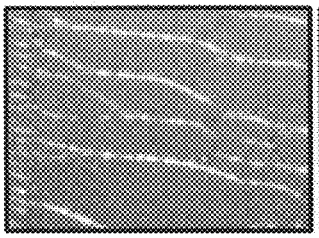
FIG. 7B is a detailed view of a first portion of the stereomicroscopic image of FIG. 7A, which is denoted as DETAIL 7B in FIG. 7A.
Figure 7C:
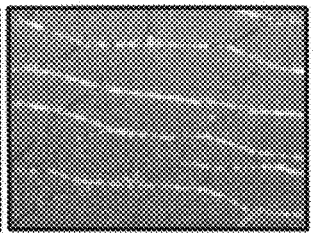
FIG. 7C is a detailed view of a second portion of the stereomicroscopic image of FIG. 7A, which is denoted as DETAIL 7C in FIG. 7A.
Figure 7D:
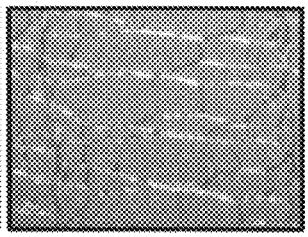
FIG. 7D is a detailed view of a third portion of the stereomicroscopic image of FIG. 7A, which is denoted as DETAIL 7D in FIG. 7A.
Figure 7E:
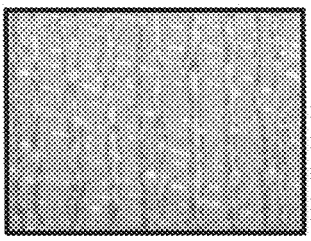
FIG. 7E is a detailed view of a fourth portion of the stereomicroscopic image of FIG. 7A, which is denoted as DETAIL 7E in FIG. 7A.
Figure 7F:
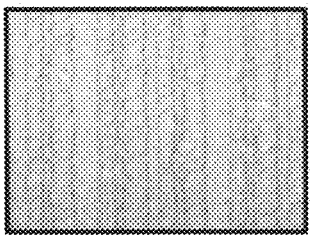
FIG. 7F is a detailed view of a fifth portion of the stereomicroscopic image of FIG. 7A, which is denoted as DETAIL 7F in FIG. 7A.
Figure 7G:
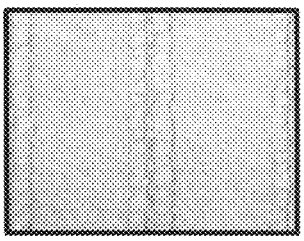
FIG. 7G is a detailed view of a sixth portion of the stereomicroscopic image of FIG. 7A, which is denoted as DETAIL 7G in FIG. 7A.

FIGS. 7A-7G illustrate the resulting pattern printed on the PCL/collagen fibrous matrix. FIG. 7A illustrates the overall pattern. FIGS. 7B-7G illustrate detailed views of various portions of the overall pattern shown in FIG. 7A. The resulting patterns display distinct morphologic variation over the graded increase of width. For input widths of 10 μm, 30 μm and 50 μm, as illustrated in FIGS. 6B, 6C, and 6D, respectively, printing did not create strips. Rather, as illustrated in FIGS. 7B, 7C, and 7D, respectively, the printing yielded a network of parallel thick microfibers (~20 μm in diameter), perpendicular to the designated strip direction and interconnected by thin microfibers (~3 μm in diameter). This demonstrates the possibility of creating a fibrous network composed solely of microfibers with controllable fiber-to-fiber distance.

In an embodiment, the deviation between designed patterns and resulting patterns may result from limited printing resolution, which, in an embodiment, comprises an etched area of 48.6±0.8 μm in diameter for 30DS. In an embodiment, an unprinted area width within this range (e.g., 10-50 μm) would result in the PCL/collagen nanofibers along the strip direction being completely etched without formation of a strip. The remaining PCL/collagen fiber bundles (i.e., $D_w$) perpendicular to the strip direction (e.g., as illustrated in FIGS. 3G and 3H) at a 30DS45DD1NN printing condition would fuse to form parallel microfibers.

For printings with an unprinted width larger than 100 μm, strips were formed with a corresponding increase of strip width. However, the widths of the printed strips were smaller than those of the pattern. For example, for input widths of 100 μm, 200 μm, and 500 μm, as illustrated in FIGS. 6E, 6F, and 6G, respectively, printing created the smaller strips shown in corresponding FIGS. 7E, 7F, and 7G. It may be inferred that this reduced width was a result of excessive etching by solvent.

Figures 8A, 8B, 8C:
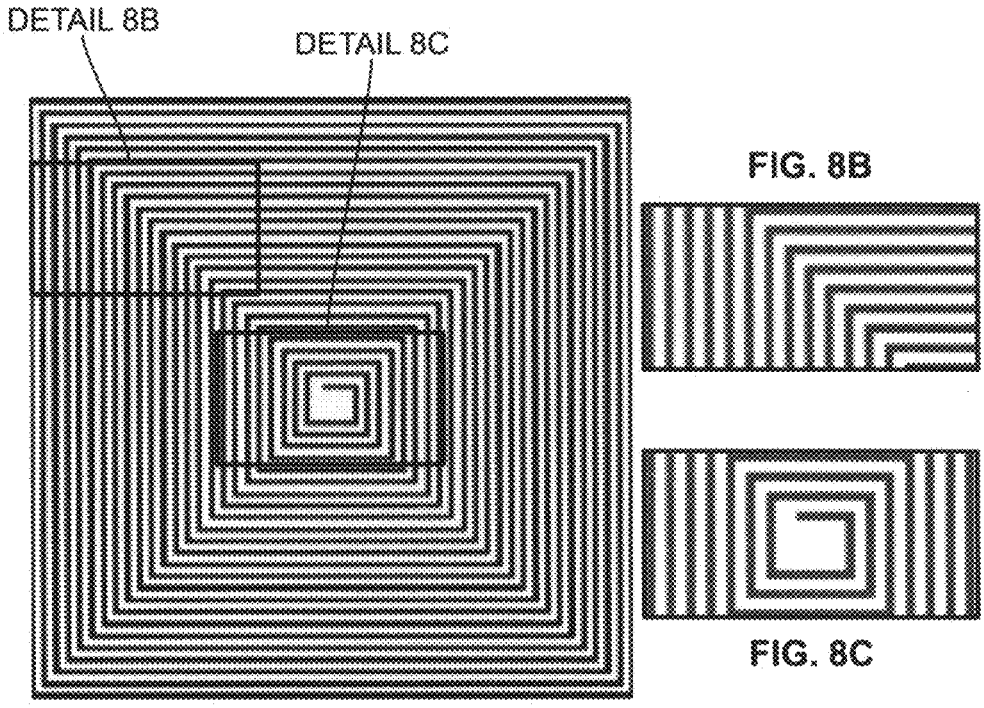
FIG. 8A is a second exemplary input pattern that may be provided to the exemplary system of FIG. 1.
FIG. 8B is a detailed view of a first portion of the exemplary input pattern of FIG. 8A, which is denoted as DETAIL 8B in FIG. 8A.
FIG. 8C is a detailed view of a second portion of the exemplary input pattern of FIG. 8A, which is denoted as DETAIL 8C in FIG. 8A.
Figure 9A:
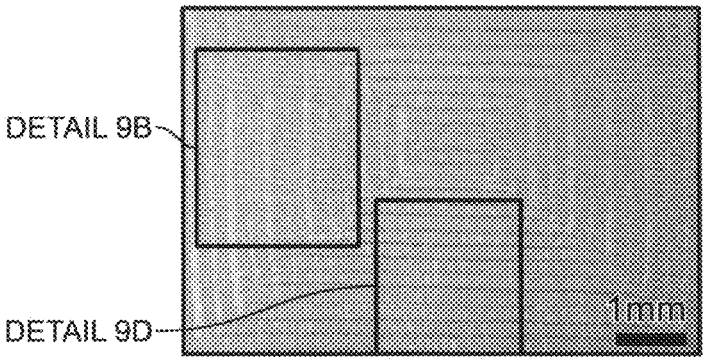
FIG. 9A is a stereomicroscopic image of a fibrous matrix that may result from printing the exemplary input pattern of FIG. 8A with the exemplary system of FIG. 1.
Figure 9B:
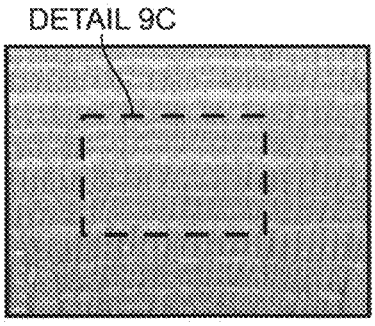
FIG. 9B is a detailed view of a first portion of the stereomicroscopic image of FIG. 9A, which is denoted as DETAIL 9B in FIG. 9A.
Figure 9C:
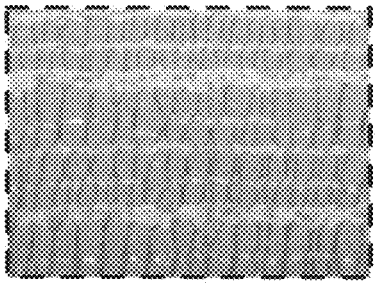
FIG. 9C is a detailed view of a portion of the stereomicroscopic image of FIG. 9B, which is denoted as DETAIL 9C in FIG. 9B.
Figure 9D:
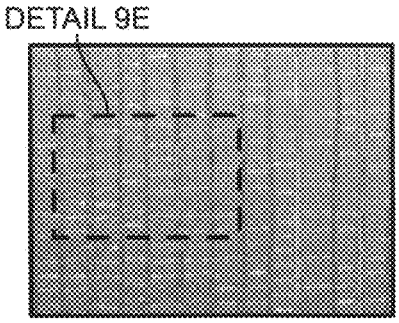
FIG. 9D is a detailed view of a second portion of the stereomicroscopic image of FIG. 9A, which is denoted as DETAIL 9D in FIG. 9A.
Figure 9E:
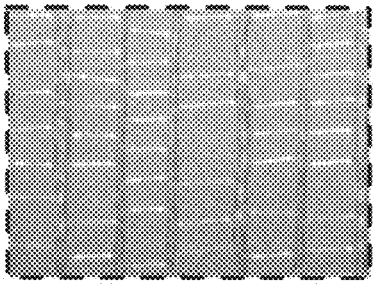
FIG. 9E is a detailed view of a portion of the stereomicroscopic image of FIG. 9D, which is denoted as DETAIL 9E in FIG. 9D.
Figure 10B:
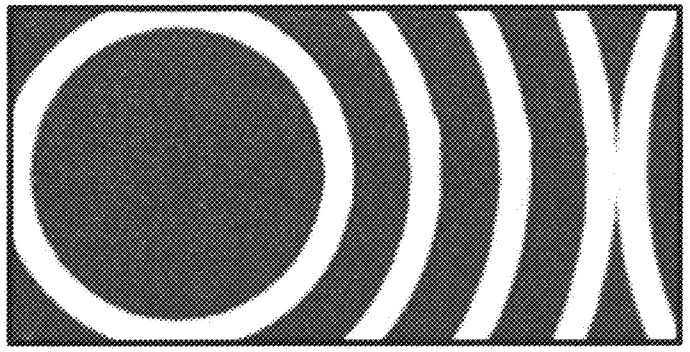
FIG. 10B is a detailed view of a portion of the exemplary input pattern of FIG. 10A, which is denoted as DETAIL 10B in FIG. 10A.
Figure 10D:
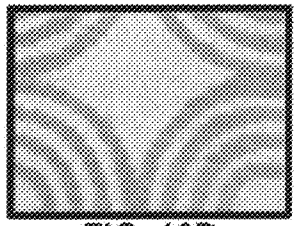
FIG. 10D is a detailed view of a first portion of the stereomicroscopic image of FIG. 10C, which is denoted as DETAIL 10D in FIG. 10C.
Figure 10F:
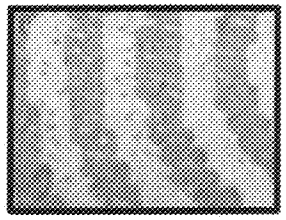
FIG. 10F is a detailed view of a portion of the stereomicroscopic image of FIG. 10E, which is denoted as DETAIL 10F in FIG. 10E.
Figure 10A:
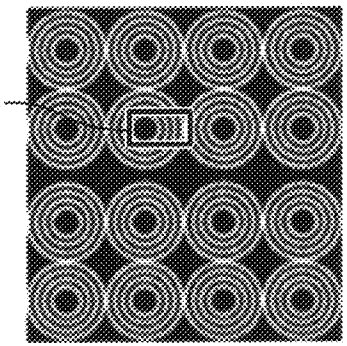
FIG. 10A is a third exemplary input pattern that may be provided to the exemplary system of FIG. 1.
Figure 10C:
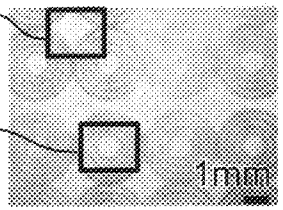
FIG. 10C is a stereomicroscopic image of a portion of a fibrous matrix that may result from printing the exemplary input pattern of FIG. 10A with the exemplary system of FIG. 1.
Figure 10E:
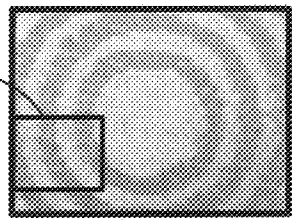
FIG. 10E is a detailed view of a second portion of the stereomicroscopic image of FIG. 10C, which is denoted as DETAIL 10E in FIG. 10C.
Figure 11B:
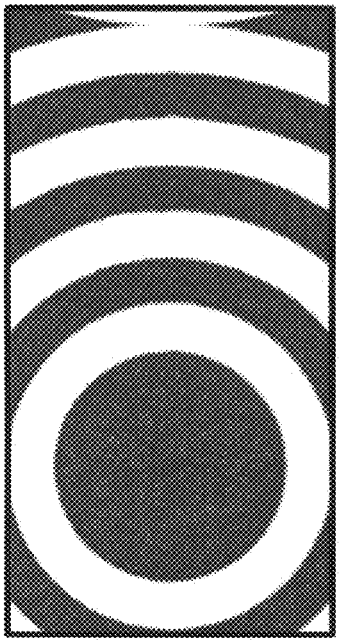
FIG. 11B is a detailed view of a portion of the exemplary input pattern of FIG. 11A, which is denoted as DETAIL 11B in FIG. 11A.
Figure 11D:
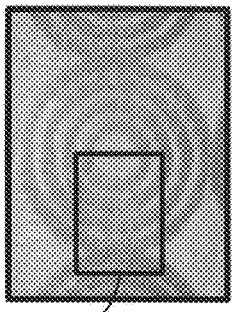
FIG. 11D is a detailed view of a portion of the stereomicroscopic image of FIG. 11C, which is denoted as DETAIL 11D in FIG. 11C.
Figure 11F:
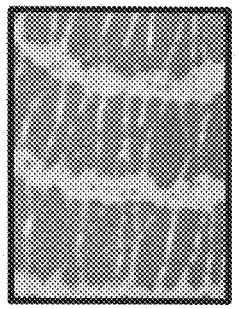
FIG. 11F is a detailed view of a portion of the stereomicroscopic image of FIG. 11E, which is denoted as DETAIL 11F in FIG. 11E.
Figure 11A:
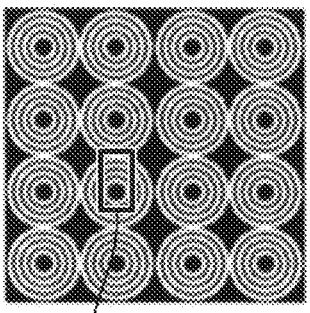
FIG. 11A is a fourth exemplary input pattern that may be provided to the exemplary system of FIG. 1.
Figure 11C:
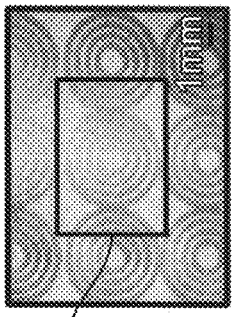
FIG. 11C is a stereomicroscopic image of a portion of a fibrous matrix that may result from printing the exemplary input pattern of FIG. 11A with the exemplary system of FIG. 1.
Figure 11E:
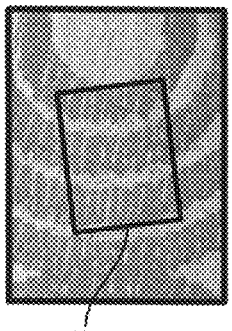
FIG. 11E is a detailed view of a portion of the stereomicroscopic image of FIG. 11D, which is denoted as DETAIL 11E in FIG. 11D.

To further determine whether the printed patterns were also related to the printing direction, a square spiral with the same printed and unprinted width of 100 μm was designed and printed on the random PCL/collagen fiber meshes. FIG. 8A illustrates the overall spiral pattern, with detailed views of portions of the pattern of FIG. 8A shown in FIGS. 8B and 8C. FIG. 9A illustrates the overall resulting pattern printed on a fibrous matrix, with detailed views of portions thereof shown in FIGS. 9B, 9C, 9D, and 9E. As shown, the printing direction significantly affected the resulting patterns. This observation further implies the possibility of generating a spatial isotropy within the same pattern.

The exemplary inkjet-printing system may be capable of reproducibly printing various patterns, which is highly desirable for inducing comparable cellular responses in cells cultured within matrices etched with identical patterns, leading to the formation of similar tissue function. FIGS. 10A-10F and 11A-11F present an evaluation of the reproducibility in printing identical printing patterns on the same matrix or different matrices, as performed using PCL/collagen fibrous matrices as model substrates and the printer 110 described above with reference to FIG. 1 as the printing platform. Two similar patterns were printed, both of which were 4×4 arrays of concentric circles. In the pattern of FIGS. 10A-10F, the printed area of the concentric circles, indicated in FIGS. 10A and 10B by white rings, was 100 μm in width, while the unprinted area, indicated by black rings, was 200 μm in width. In the pattern of FIGS. 11A-11F, both the printed area the printed area of the concentric circles, indicated in FIGS. 11A and 11B in white, and the unprinted area, indicated in black, were 200 μm in width. FIGS. 10C-10F and 11C-11F demonstrate that the resulting patterns were similar to each other and identical to the original input AutoCAD patterns. In both cases, the printed area was larger than the input and the unprinted area was smaller. This was mainly because the solvent diffusion dissolved more nanofiber of the substrate than expected.

Figure 12C:
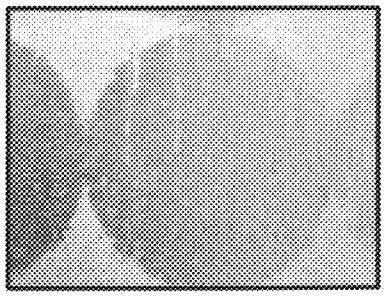
FIG. 12C is a stereomicroscopic image of a second portion of a fibrous matrix that may result from printing the exemplary input pattern of FIG. 12A with the exemplary system of FIG. 1.
Figure 12B:
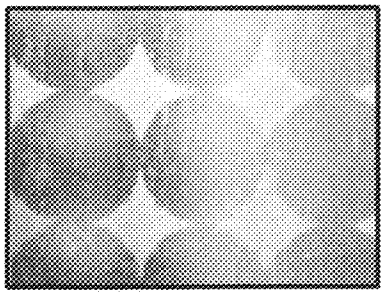
FIG. 12B is a stereomicroscopic image of a first portion of a fibrous matrix that may result from printing the exemplary input pattern of FIG. 12A with the exemplary system of FIG. 1.
Figure 12E:
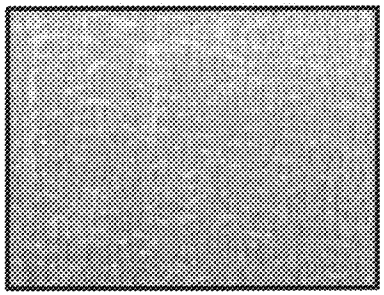
FIG. 12E is a stereomicroscopic image of a fourth portion of a fibrous matrix that may result from printing the exemplary input pattern of FIG. 12A with the exemplary system of FIG. 1.
Figure 12D:
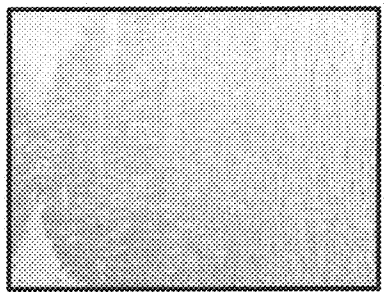
FIG. 12D is a stereomicroscopic image of a third portion of a fibrous matrix that may result from printing the exemplary input pattern of FIG. 12A with the exemplary system of FIG. 1.
Figure 12A:
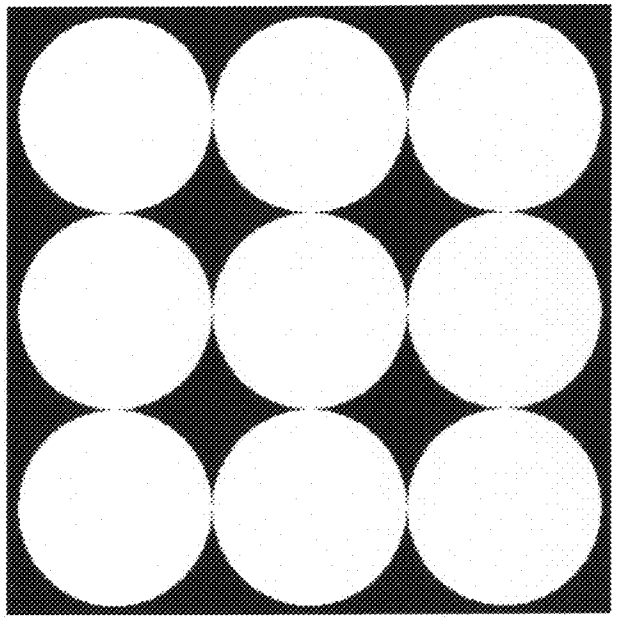
FIG. 12A is a fifth exemplary input pattern that may be provided to the exemplary system of FIG. 1.
Figure 13C:
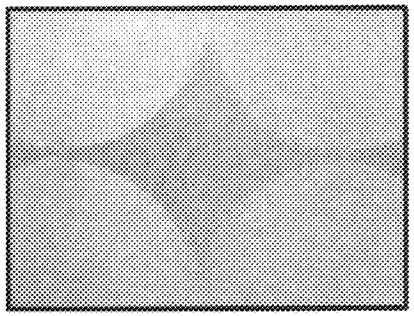
FIG. 13C is a stereomicroscopic image of a second portion of a fibrous matrix that may result from printing the exemplary input pattern of FIG. 13A with the exemplary system of FIG. 1.
Figure 13B:
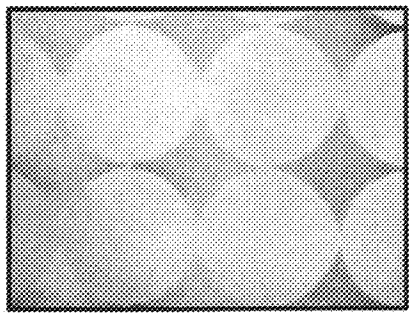
FIG. 13B is a stereomicroscopic image of a first portion of a fibrous matrix that may result from printing the exemplary input pattern of FIG. 13A with the exemplary system of FIG. 1.
Figure 13E:
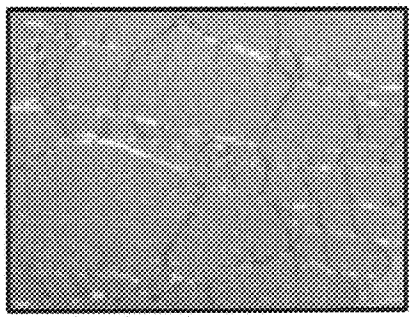
FIG. 13E is a stereomicroscopic image of a fourth portion of a fibrous matrix that may result from printing the exemplary input pattern of FIG. 13A with the exemplary system of FIG. 1.
Figure 13D:
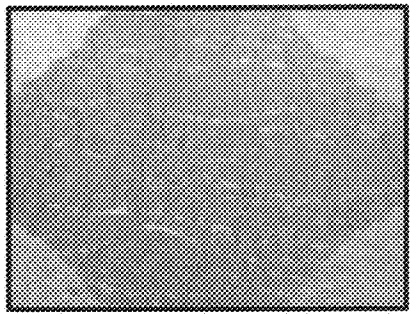
FIG. 13D is a stereomicroscopic image of a third portion of a fibrous matrix that may result from printing the exemplary input pattern of FIG. 13A with the exemplary system of FIG. 1.
Figure 13A:
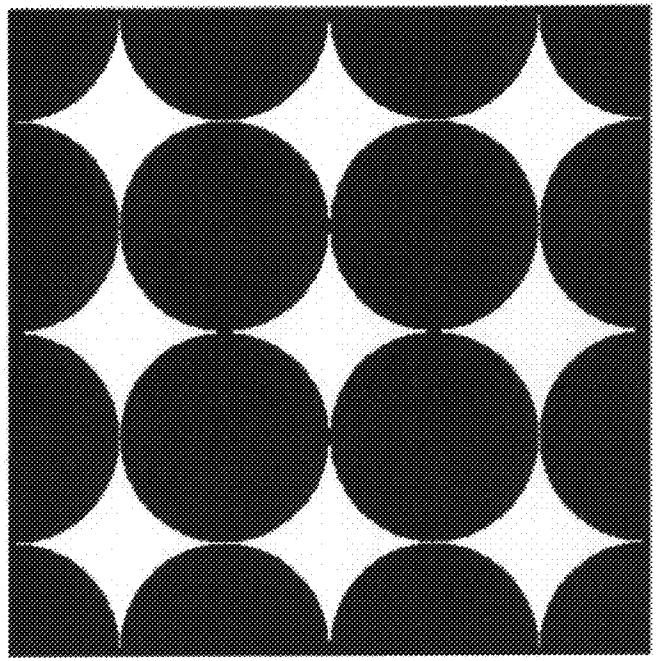
FIG. 13A is a fifth exemplary input pattern that may be provided to the exemplary system of FIG. 1.

FIGS. 12A-12E and 13A-13E further demonstrate this diffusion. FIG. 12A illustrates a pattern including a 3×3 array of printed connected circles 4 mm in diameter. FIG. 13A illustrates a pattern including an inverse of the 3×3 array of FIG. 12A. FIGS. 12B-12E illustrate the patterned meshes produced by printing the pattern of FIG. 12A at varying levels of magnification, while FIGS. 13B-13E illustrate the patterned meshes produced by printing the pattern of FIG. 13A at varying levels of magnification. All of the microetching printings yielded patterns similar to the original input AutoCAD patterns, further confirming the high reproducibility of the present invention.

In the next step of the exemplary technique, cells may be cultured onto the patterned scaffolds fabricated through the printing process described above. Various cell types may be cultured onto the scaffolds. In an embodiment, endothelial cells may be cultured onto the patterned scaffolds. In an embodiment, fibroblasts may be cultured onto the patterned scaffolds. In an embodiment, neuron cells may be cultured onto the patterned scaffolds. In an embodiment, human neuron stem cells may be cultured onto the patterned scaffolds. In an embodiment, mouse endothelial cells may be cultured onto the patterned scaffolds. In an embodiment, normal human dermal fibroblast ("NHDF") cells may be cultured onto the patterned scaffolds.

Extensive studies have demonstrated the superiority of electrospun fibrous matrices in promoting the attachment, proliferation and differentiation of cells. In particular, collagen-containing fibrous matrices have received special attention for their biological similarity to the extracellular matrix ("ECM"), which supports growth of many cells such as fibroblasts, endothelial cells, etc. In addition, increasing evidence highlights the correlation between geometrical dimensions of cell-growing substrates and cell morphology, as well as their function.

To further demonstrate the potential utility of patterned fibrous matrices, especially in biomedical applications, e.g., induction of differential cell organization, the exemplary embodiments were used to fabricate PCL/collagen nanofiber meshes with an array of concentric circle patterns (e.g., the pattern described above with reference to FIG. 10A). The meshes created in this manner were fabricated and seeded with normal human dermal fibroblast cells ("NHDF") and green fluorescence protein-labeled mouse endothelial cells (Ms-1). Upon culture for 3 days, the NHDF cells were stained with phalloidin and DAPI for cell nuclei, and MS-1 cells were stained with DAPI and then examined under an epifluorescence microscope. The Figures to be discussed hereinafter demonstrate that cells cultured as described above closely follow the printed patterns by only attaching to the material surface (e.g., unprinted PCL/collagen nanofiber areas and microfiber networks).

Figure 14A:
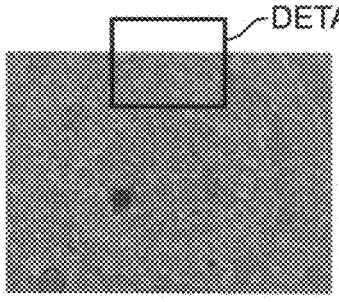
FIG. 14A is an epifluorescence microscope image of a first portion of a culture of normal human dermal fibroblast ("NHDF") cells cultured onto a concentric circle patterned fibrous matrix fabricated according to an exemplary embodiment.
Figure 14C:
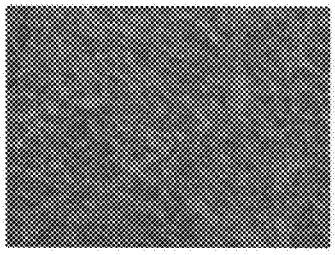
FIG. 14C is an epifluorescence microscope image of a second portion of the culture of FIG. 14A.
Figure 14E:
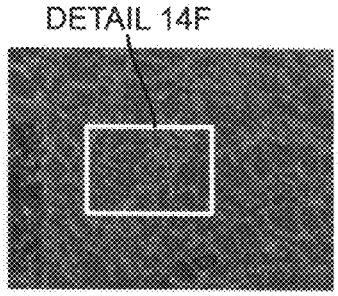
FIG. 14E is an epifluorescence microscope image of a fourth portion of the culture of FIG. 14A.
Figure 14B:
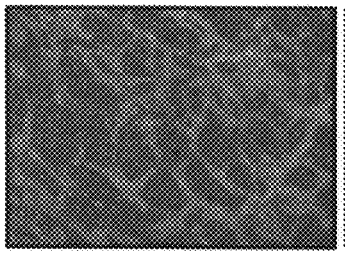
FIG. 14B is a detailed view of a portion of the epifluorescence microscope image of FIG. 14A, which is denoted as DETAIL 14B in FIG. 14A.
Figure 14D:
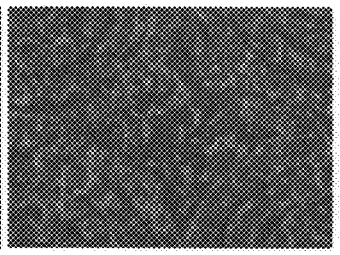
FIG. 14D is an epifluorescence microscope image of a third portion of the culture of FIG. 14A.
Figure 14F:
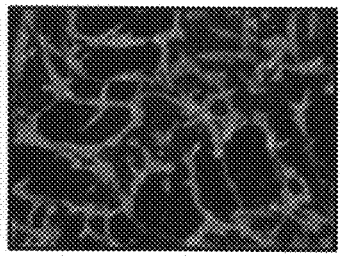
FIG. 14F is a detailed view of a portion of the epifluorescence microscope image of FIG. 14E, which is denoted as DETAIL 14F in FIG. 14E.

Referring now to FIGS. 14A-14L, FIG. 14A shows an epifluorescence microscope image of a portion of a mesh seeded with NHDF cells. FIG. 14B shows a magnified view of a portion of the image of FIG. 14A, in which it can be seen that on narrow printed strips (e.g., <100 μm in width) cells oriented in the same direction. FIGS. 14C and 14D show that on the large unprinted area, the cells exhibited a random arrangement without a preferred orientation. FIG. 14F shows a magnified view of a portion of the image of FIG. 14E, in which it can be seen that the cell orientation described above for narrow printed strips with reference to FIG. 14B is even more pronounced with microfibers (e.g., ~10 μm in diameter), along which cells elongated and connected to other cells of the unprinted area.

Figure 14G:
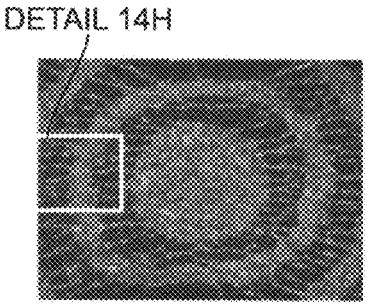
FIG. 14G is an epifluorescence microscope image of a first portion of a culture of mouse endothelial ("MS-1") cells cultured onto a concentric circle patterned fibrous matrix fabricated according to an exemplary embodiment.
Figure 14I:
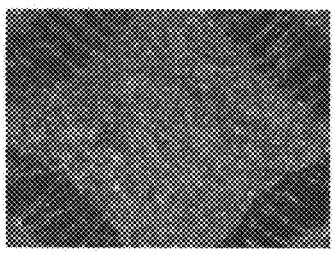
FIG. 14I is an epifluorescence microscope image of a second portion of the culture of FIG. 14G.
Figure 14J:
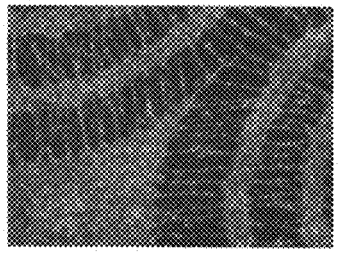
FIG. 14J is an epifluorescence microscope image of a third portion of the culture of FIG. 14G.
Figure 14H:
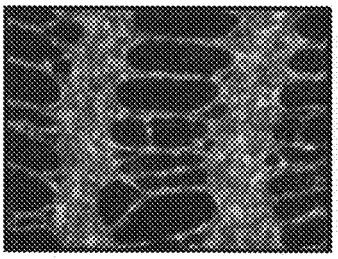
FIG. 14H is a detailed view of a portion of the epifluorescence microscope image of FIG. 14G, which is denoted as DETAIL 14H in FIG. 14G.
Figure 14K:
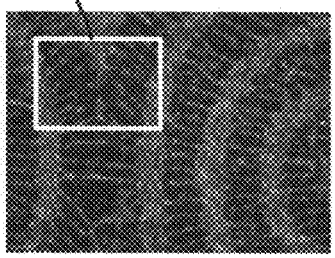
FIG. 14K is an epifluorescence microscope image of a fourth portion of the culture of FIG. 14G.
Figure 14L:
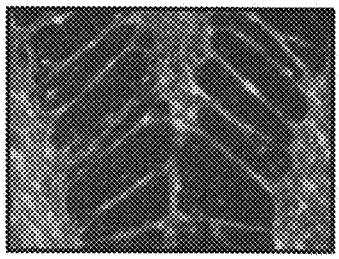
FIG. 14L is a detailed view of a portion of the epifluorescence microscope image of FIG. 14K, which is denoted as DETAIL 14L in FIG. 14K.

FIG. 14G shows an epifluorescence microscope image of a portion of a mesh similar to that of FIGS. 14A-14L, seeded with MS-1 cells. FIG. 14H shows a magnified view of a portion of the image of FIG. 14G, which demonstrates orientation similar to that described above with reference to FIG. 14B. FIGS. 14I and 14J show random cell arrangement of unprinted areas. FIG. 14L shows a magnified view of a portion of the image of FIG. 14K, which further demonstrates pronounced cell orientation effects for microfibers.

Figures 15A, 15B, 15C, 15D, 15E:
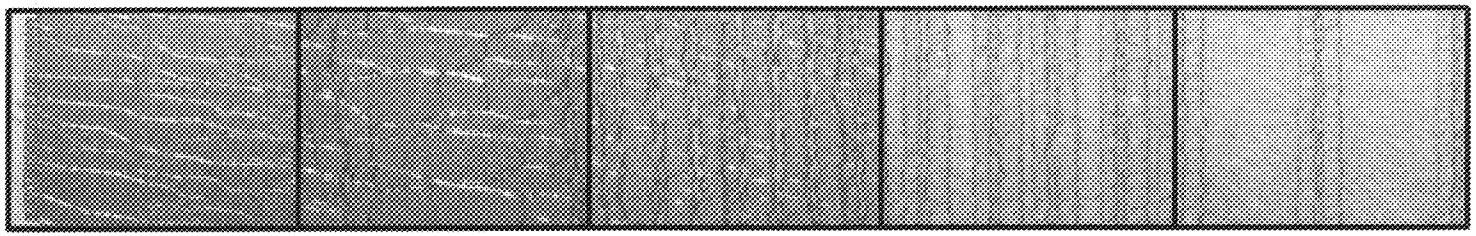
FIG. 15A is a stereomicroscopic image of a first parallel strip printed fibrous matrix fabricated according to an exemplary embodiment.
FIG. 15B is a stereomicroscopic image of a second parallel strip printed fibrous matrix fabricated according to an exemplary embodiment.
FIG. 15C is a stereomicroscopic image of a third parallel strip printed fibrous matrix fabricated according to an exemplary embodiment.
FIG. 15D is a stereomicroscopic image of a fourth parallel strip printed fibrous matrix fabricated according to an exemplary embodiment.
FIG. 15E is a stereomicroscopic image of a fifth parallel strip printed fibrous matrix fabricated according to an exemplary embodiment.
Figures 16A, 16B, 16C, 16D, 16E:
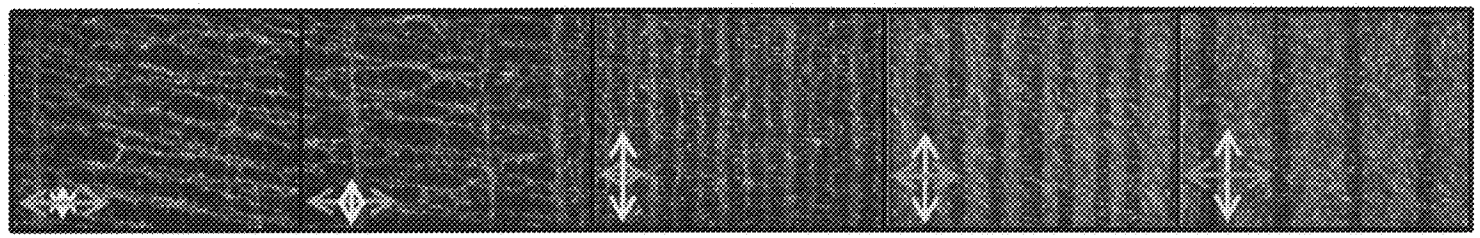
FIG. 16A is an epifluorescence microscope image of a culture of MS-1 cells cultured onto the fibrous matrix of FIG. 15A.
FIG. 16B is an epifluorescence microscope image of a culture of MS-1 cells cultured onto the fibrous matrix of FIG. 15B.
FIG. 16C is an epifluorescence microscope image of a culture of MS-1 cells cultured onto the fibrous matrix of FIG. 15C.
FIG. 16D is an epifluorescence microscope image of a culture of MS-1 cells cultured onto the fibrous matrix of FIG. 15D.
FIG. 16E is an epifluorescence microscope image of a culture of MS-1 cells cultured onto the fibrous matrix of FIG. 15E.

The above result of the assessment of FIGS. 14A-14L is consistent with the previous finding that microgrooved patterns with a groove width less than 100 μm can direct cellular alignment and elongation. FIGS. 15A-15E and 16A-16E provide a further demonstration of the spatial control of cell morphology through the use of one-dimensional printed strip patterns. FIGS. 15A-15E present stereomicroscopic images of printed matrices resulting from the printing thereon of patterns of parallel strips having differing widths according to the exemplary techniques described above. In FIG. 15A, the printed strips have widths of 10-30 μm; in FIG. 15B, the printed strips have a width of 50 μm; in FIG. 15C, the printed strips have a width of 100 μm; in FIG. 15D, the printed strips have a width of 200 μm; in FIG. 15E, the printed strips have a width of 500 μm. FIGS. 16A-16E present epiluorescence microscopic images of results after MS-1 cells were cultured onto the matrix shown in the corresponding one of FIGS. 15A-15E for three days, with cell nuclei stained blue by 4',6-diamidino-2-phenylindole ("DAPI"). In FIGS. 16A-16E, the yellow arrows indicate the orientation of cells in the horizontal direction on the fiber surface, while the orange arrows indicate the orientation of cells in the vertical direction on the fiber surface; in either case, the size of the arrows indicates the number of cells oriented in the corresponding direction. Considering FIGS. 14A-14L, 15A-15E and 16A-16E collectively, it may be observed that it is the contact guidance that primarily regulates the spatial distribution and morphologic difference of mouse endothelial ("MS-1") cells.

Figure 17A:
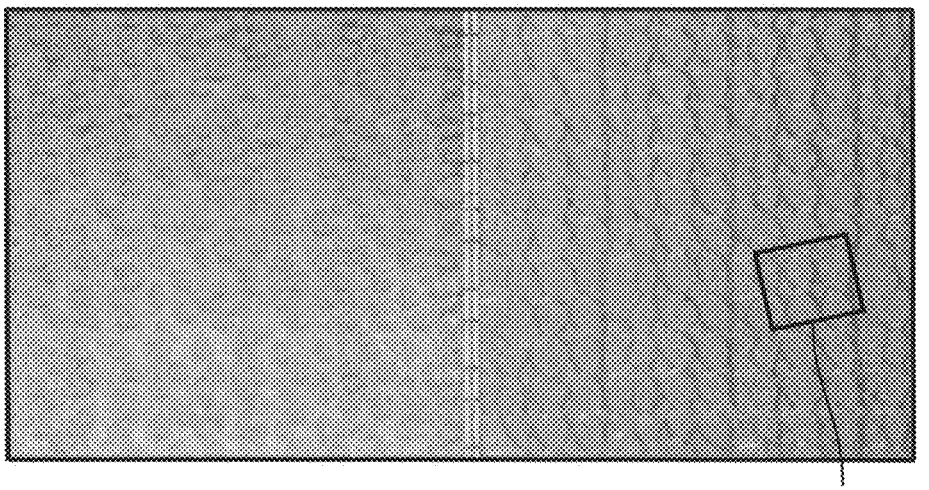
FIG. 17A is a stereomicroscopic image of a printed fibrous matrix according to an exemplary embodiment.
Figure 17B:
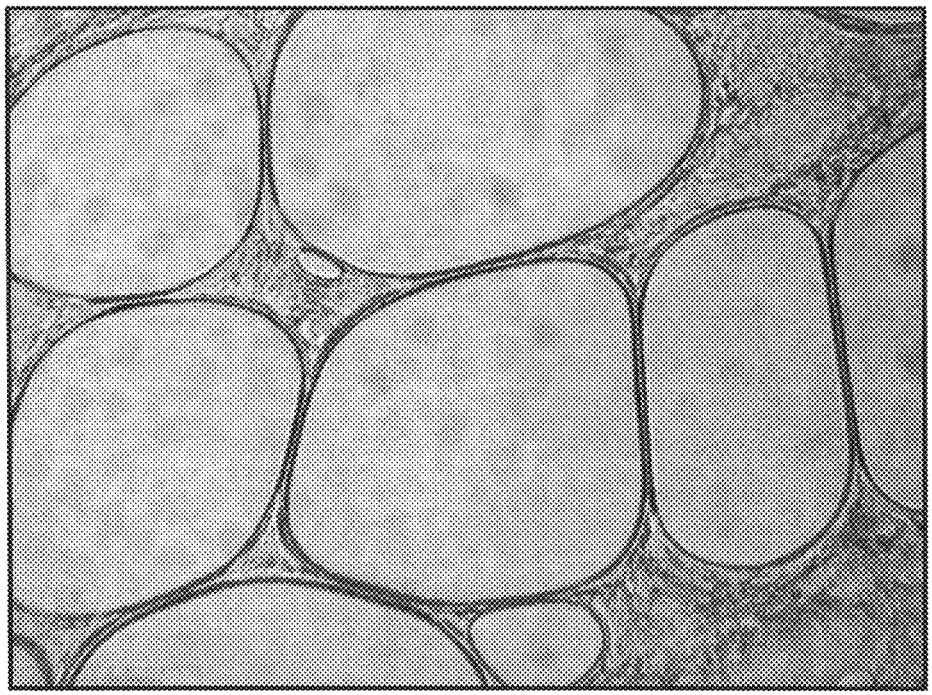
FIG. 17B is an inverted detailed view of a portion of the printed fibrous matrix of FIG. 17A, which is denoted as DETAIL 17B in FIG. 17A.

To further elaborate the utility of patterned fibrous matrices, especially regulation of cellular functions, human fetal neural stem cells (hNSCs) were cultured onto printed PCL/collagen matrices with segregated domains of small and large etched pores. FIG. 17A illustrates a microscopic view of a matrix printed with a 30DS45DD1NN printing setup, in which the left portion of the matrix was printed with 200-μm unprinted width and 50-μm printed width to generate small isolated pores across the nanofiber matrix, and the right portion of the matrix was printed with 50-μm unprinted width and 50-μm printed width to etch away a majority of nanofibers, yielding large pores along with the formation of bridging microfibers. FIG. 17B illustrates an inverted microscopic view of a portion of the right side of FIG. 17A, showing large pores.

Figure 18A:
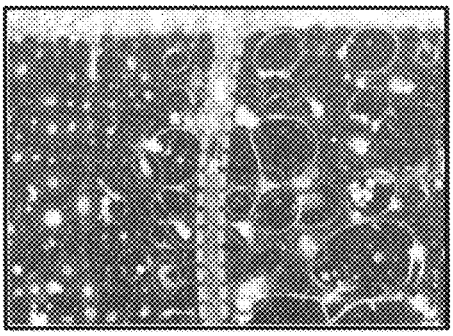
FIG. 18A is a phase contact microscope image of a culture of human fetal neural stem cells ("hNSCs") cultured onto the printed fibrous matrix of FIG. 17A with trophic and mitotic factors.
Figure 18B:
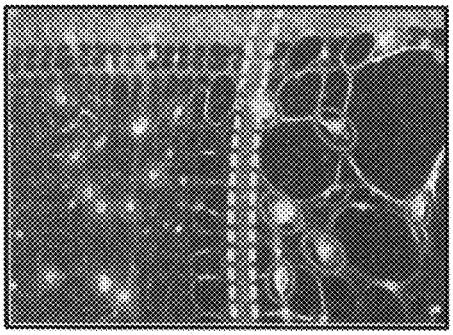
FIG. 18B is a phase contact microscope image of a culture of hNSCs cultured onto the printed fibrous matrix of FIG. 17A without trophic and mitotic factors.

FIGS. 18A-18F present phase contact microscope images of a culture of hNSCs attached to the fibrous matrix surface and the neurite outgrowth therefrom. It was found that unprinted PCL/collagen nanofiber areas supported the attachment and proliferation of hNSCs in their progenitor status. FIG. 18A shows a portion of the culture spanning the divide between small pores and large pores illustrated in FIG. 17A. The colonies of hNSCs in the small pore domain (i.e., red circles) were smaller with shorter neurites than those in the large pore domain that appeared discernibly larger with longer neurites (i.e., blue circles). This observation suggests that hNSCs in the smaller pore domain have a better migratory capability, preventing the formation of large colonies. FIG. 18B shows a culture on the same area of a matrix cultured without trophic or mitotic factors, which indicates that deprivation of trophic and mitotic factors does not alter the cell attachment profile on either the small or large pores. These effects may become even more evident on unpatterned nanofiber matrices, where hNSCs spread well but do not form recognizable colonies.

Figure 18C:
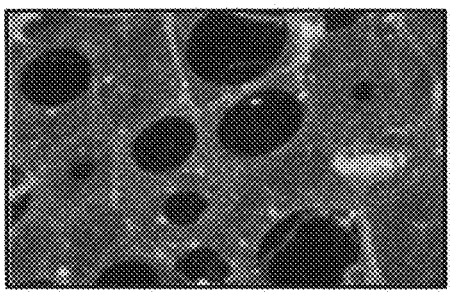
FIG. 18C is a phase contact microscope image showing neural filament M ("NFM") in cells cultured on a first portion of the printed fibrous matrix of FIG. 17A.
Figure 18D:
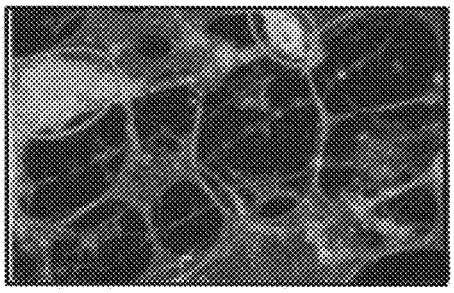
FIG. 18D is a phase contact microscope image showing NFM cells cultured on a second portion of the printed fibrous matrix of FIG. 17A.
Figure 18E:
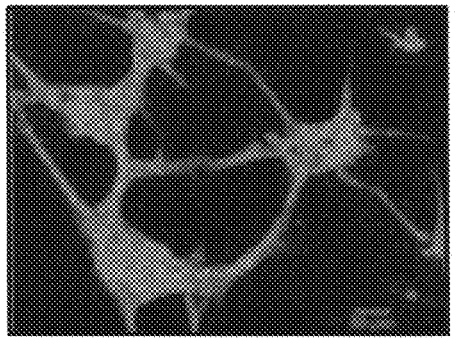
FIG. 18E is a phase contact microscope image showing TUJ1 in cells cultured on a first portion of the printed fibrous matrix of FIG. 17A.
Figure 18F:
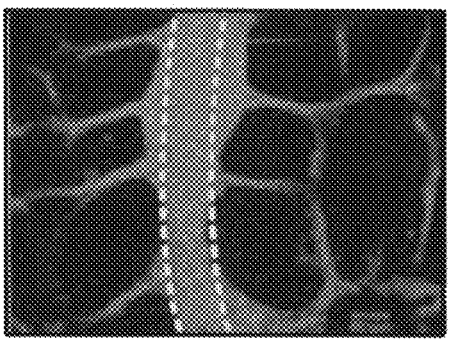
FIG. 18F is a phase contact microscope image showing TUJ1 in cells cultured on a second portion of the printed fibrous matrix of FIG. 17A.

FIG. 18C shows further detail of the culture grown on the small pore area when deprived of trophic and mitotic factors. In FIG. 18C, noticeable induction of neural phenotypic differentiation is indicated by strong expression in the cells of neural filament M ("NFM"), a neuronal marker indicated in green. FIG. 18D shows further detail of the culture grown on the large pore area when deprived of trophic and mitotic factors and indicates strong expression of NFM in this area as well. FIG. 18E shows further detail of the culture grown on the small pore area when deprived of trophic and mitotic factors. In FIG. 18E, high expression in the cells of TUJ1, an early neuronal marker shown in red, is indicated. FIG. 18F shows further detail of the culture grown on the large pore area when deprived of trophic and mitotic factors and indicates strong expression of TUJ1 in this area as well. It may further be observed that although both patterns supported neural differentiation, the neurite extension, which is important in forming the neuronal network, was much longer for the cells cultured on the portion of the matrix including large pores than for cells on the cultured on the portion of the matrix including small pores. It may also be observed that the outgrowth of neurites followed the microfiber contour in the portion of the matrix with large pore domain, suggesting the guiding role of bridging microfibers in neurite outgrowth.

Figure 19A:
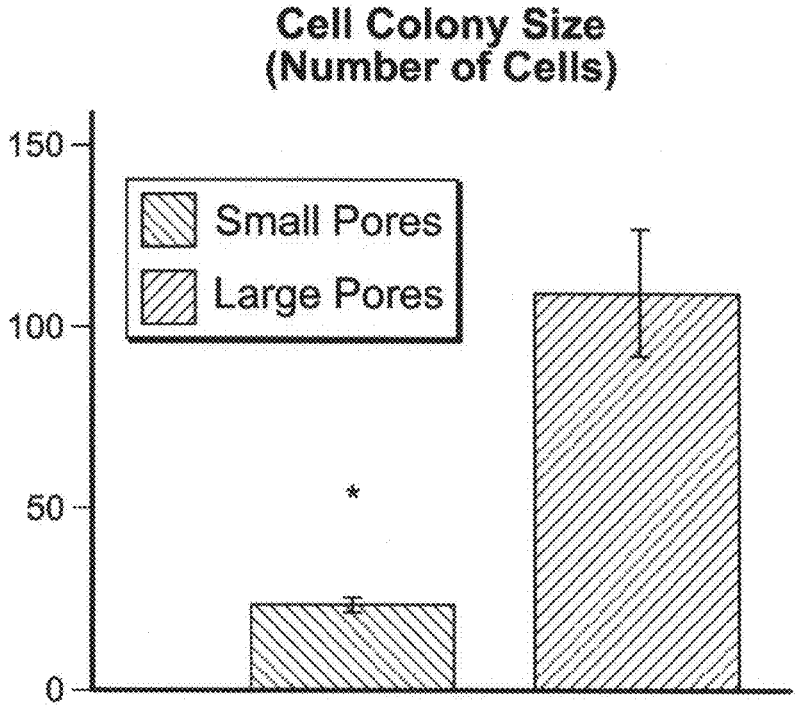
FIG. 19A is a graph comparing the size of cell colonies cultured on matrices with small and large pores.
Figure 19B:
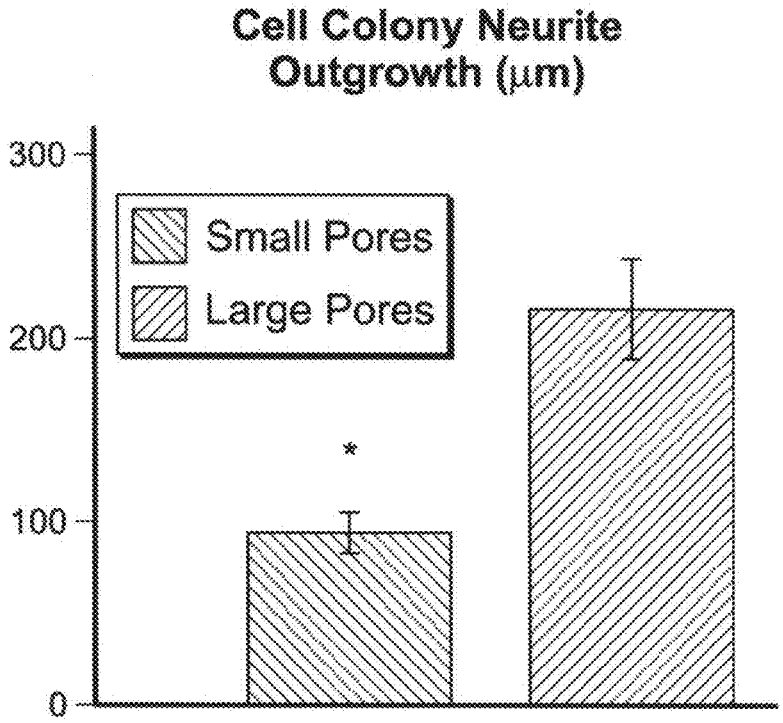
FIG. 19B is a graph comparing the length of cell colony neurite outgrowth in cell colonies cultured on matrices with small and large pores.

Quantitative analysis further confirms that patterned matrices with large pores significantly nurtured larger cell colonies (in an embodiment, it was found that there were 111±17 cells/colony with large pores vs. 24±2 cells/colony with small pores; t-test, $p<0.05$) and longer neurite outgrowth distance (217±27 μm with large pores vs. 94±11 μm with small pores; t-test, $p<0.05$). FIGS. 19A and 19B show the results of the above-described analysis; in FIGS. 19A and 19B, the asterisks indicate a p-value less than 0.05 in the statistical analysis.

The exemplary embodiments have been described above with specific reference to etching of patterns on a single fibrous matrix. In another embodiment, etched fiber layers can be used to form three-dimensional constructs using a bottom-up layer-by-layer assembly process.

The exemplary embodiments have a variety of applications. In an embodiment, the exemplary embodiments may be applied to create various patterns on fibrous matrices to understand how an ECM regulates cell phenotypic expression by topography. In an embodiment, the exemplary embodiments may be used in angiogenesis, i.e., the use of a pure microfiber network as a template for a blood vessel network. In an embodiment, the exemplary embodiments may be used in neurogenesis, i.e., the use of nanofiber islands connected with microfibers as a scaffold for neuron outgrowth. In such an embodiment, nanofibers may provide a medium to which cells may attach and microfibers may guide the outgrowth of the neuritis. In an embodiment, the exemplary embodiments may be used to create large pores/channels on the matrices through solvent etching while still keeping the nanofiber morphology. The use of such nanofiber meshes for layer-by-layer tissue reconstruction can efficiently resolve cell infiltration, nutrition and oxygen transport and waste removal problems associated with current layer-by-layer assembled tissue grafts.

It should be understood that the embodiments described herein are merely exemplary in nature and that a person skilled in the art may make many variations and modifications thereto without departing from the scope of the present invention. All such variations and modifications, including those discussed above, are intended to be included within the scope of the invention.

What is claimed is:

1. A method for fabricating a patterned fibrous matrix, comprising the steps of:

providing an inkjet printer adapted to use an etching solvent as an ink;

providing a fibrous matrix, including a plurality of fibers, as a printing medium;

providing said etching solvent for said inkjet printer, said etching solvent being adapted to at least partially dissolve said plurality of fibers of said fibrous matrix upon contact of said etching solvent to said plurality of fibers;

configuring said inkjet printer to print a pattern on said fibrous matrix;

operating said inkjet printer to print said pattern on said fibrous matrix by contacting some of said plurality of fibers with said etching solvent to produce contacted fibers, said etching solvent forming said pattern by at least partially dissolving some of said contacted fibers to form a printed area on said fibrous matrix and fusing together others of said contacted fibers to form fused fibers, said fused fibers being thicker than unfused fibers of said plurality of fibers of said fibrous matrix.

2. The method of claim 1, wherein said etching solvent includes one or more of hexafluoroisopropanol, dimethylformamide, dichloromethane, chloroform, trifluoroethanoic acid, water, a protein, a peptide, a hormone, a cell, DNA, and bovine serum albumin.

3. The method of claim 2, wherein said etching solvent includes hexafluoroisopropanol and dimethylformamide at a ratio of about 9:1.

4. The method of claim 2, wherein said etching solvent includes hexafluoroisopropanol and bovine serum albumin.

5. The method of claim 1, wherein said fibrous matrix includes one or more of polycaprolactone, collagen, poly(lactic-co-glycolic acid), polyethylene glycol, poly(ethylene oxide), fibrinogen, gelatin, polylactic acid, and polyglycolic acid.

6. The method of claim 5, wherein said fibrous matrix includes a polycaprolactone (8%)/collagen (8%) (1:1 v/v) blend solution.

7. The method of claim 1, wherein said fibrous matrix is fabricated by a process including electrospinning.

8. The method of claim 1, wherein said inkjet printer includes a piezoelectric inkjet printer.

9. The method of claim 1, wherein said patterned fibrous matrix includes a three-dimensional construct.

10. The method of claim 1, wherein said patterned fibrous matrix includes a groove having a width less than about 100 μm.

11. The method of claim 1, further comprising the step of culturing a cell culture on said patterned fibrous matrix.

12. The method of claim 11, wherein said cell culture includes one of normal human dermal fibroblast cells, mouse endothelial cells, and human fetal neural stem cells.

13. The method of claim 1, further comprising the step of configuring a printing parameter of said inkjet printer based on a desired parameter of said patterned fibrous matrix.

14. The method of claim 13, wherein said printing parameter is one of a drop size, a drop distance, and a quantity of printing nozzles.

15. The method of claim 14, wherein said drop size is in a range from about 3.75 picoliters to about 10 picoliters.

16. The method of claim 14, wherein said drop distance is a range from about 15 microns to about 90 microns.

17. The method of claim 14, wherein said quantity of printing nozzles is in a range from one to sixteen.

18. The method of claim 13, wherein said parameter of said patterned fibrous matrix is one of a pore size and a width of an unprinted area.

19. The method of claim 1, wherein said pattern is formatted in a computer-aided design format.

* * * * *